US008066247B2

(12) United States Patent
Spera

(10) Patent No.: US 8,066,247 B2
(45) Date of Patent: Nov. 29, 2011

(54) MODULAR SHORING ASSEMBLY WITH LENGTH ADJUSTABLE SUPPORT

(75) Inventor: Vittorio Spera, Leonard (CA)

(73) Assignee: Anne-Marie Spera, Quebec (CA)

( * ) Notice: Subject to any disclaimer, the term of this patent is extended or adjusted under 35 U.S.C. 154(b) by 74 days.

(21) Appl. No.: 12/440,399

(22) PCT Filed: Sep. 6, 2007

(86) PCT No.: PCT/CA2007/001578

§ 371 (c)(1),
(2), (4) Date: Apr. 3, 2009

(87) PCT Pub. No.: WO2008/028297

PCT Pub. Date: Mar. 13, 2008

(65) Prior Publication Data

US 2009/0266950 A1 Oct. 29, 2009

Related U.S. Application Data

(60) Provisional application No. 60/824,729, filed on Sep. 6, 2006.

(51) Int. Cl.
*A47F 5/00* (2006.01)

(52) U.S. Cl. ..... 248/354.5; 248/423; 248/354.1; 248/407; 52/169.9

(58) Field of Classification Search ..... 248/125.8, 248/161, 423, 188.5, 351, 354.5, 354.1, 407, 248/157; 52/169.9, 835
See application file for complete search history.

(56) References Cited

U.S. PATENT DOCUMENTS

| | | | | |
|---|---|---|---|---|
| 453,094 | A | 5/1891 | Taylor | |
| 818,005 | A * | 4/1906 | Turner et al. | 248/423 |
| 2,302,237 | A * | 11/1942 | McFall | 248/161 |
| 2,989,329 | A * | 6/1961 | Noah | 403/107 |
| 3,822,850 | A * | 7/1974 | Elias | 248/551 |
| 4,580,804 | A | 4/1986 | Weber | |
| 5,335,754 | A * | 8/1994 | Gibson | 182/204 |
| 5,520,360 | A | 5/1996 | Wensman | |
| 6,138,973 | A * | 10/2000 | Woodward | 248/423 |
| 6,746,183 | B1 * | 6/2004 | Sullivan | 405/272 |
| 6,964,542 | B1 * | 11/2005 | Sullivan | 405/272 |
| 7,584,932 | B2 * | 9/2009 | Shih | 248/354.3 |

* cited by examiner

*Primary Examiner* — Terrell McKinnon
*Assistant Examiner* — Bradley Duckworth
(74) *Attorney, Agent, or Firm* — Kilpatrick Townsend & Stockton LLP

(57) ABSTRACT

A modular shoring assembly is described. Also described is a length-adjustable support for use with said modular shoring assembly which allows for the height of the shoring assembly to be quickly modified. Also described is a support frame and support panel system as well as a support beam.

16 Claims, 22 Drawing Sheets

MODULAR SHORING ASSEMBLY WITH LENGTH ADJUSTABLE SUPPORT

FIELD OF INVENTION

The present invention relates generally to the field of modular shoring for use in structural support applications, and more particularly to a modular shoring assembly with length adjustable support.

BACKGROUND OF THE INVENTION

Shoring structures are used in various situations where temporary support is required. For example, shoring structures are commonly used in building construction to provide support for building structures and to allow workers access to areas above ground level.

Many of the prior art shoring systems and assembly techniques for such systems are not well-suited for so-called "flying form" structures familiar to those skilled in the art. These flying form structures are typically used when pouring concrete floors. A wet concrete floor is poured and is supported by the shoring structure until the wet concrete cures. Once the wet concrete has cured, the shoring structure beneath the floor can be removed, "flown" above the newly cured first floor, and positioned for a second floor to be poured above the first. A shoring support whose height may be quickly decreased and quickly restored can be easily transferred from beneath a concrete floor to a position above that same floor.

In addition, many prior art shoring systems lack versatility, as they cannot be assembled and disassembled quickly and conveniently. Shoring systems typically comprise vertical supports, such as elongate posts, and horizontal supports, such as support braces, at a minimum. These vertical and horizontal supports must be attached together firmly and securely to provide adequate structural support.

Therefore a need exists for a shoring system that can be easily modified in height to allow for it to be conveniently used in a "flying form" structure. In addition, a need exists for a shoring system that is versatile, and in which vertical and horizontal supports can be easily connected and disconnected from one another.

These and other objects and advantages of the present invention will be apparent from the following detailed description of the invention and the preferred embodiments thereof.

SUMMARY OF THE INVENTION

In one aspect of the there is a length-adjustable support, the support having a first elongate member and a second elongate member for telescopic sliding engagement with the first elongate member, the said members being movable relative to each other from a collapsed position to an extended position, with one of said members providing a first slot therein in a longitudinal direction thereof that is in communication with a second slot therein transversely disposed thereto, and with another of said members providing a third slot therein in registry with the second slot when the first and second members are in telescopic sliding engagement and in the said extended position, the support having a pin locatable within the said first and second slots and within the said third slot for relative movement with the first and second members, wherein locating of the pin within the second and third slots and outside of the first slot maintains the first and second members in the said extended position thereof and locating of the pin within the first slot enables the first and second members to move from said extended position to said collapsed position.

In another aspect of the invention, there is a length-adjustable support, the support having a first elongate member, a second elongate member, and a third elongate member, each for telescopic sliding engagement with the other said members, the said members being movable relative to each other from a collapsed position to an extended position with one of said members providing a first slot therein in a longitudinal direction thereof that is in communication with a second slot therein transversely disposed thereto, and with another of said members providing a third slot therein, and with another of said members providing a fourth slot therein in a longitudinal direction thereof that is in communication with a fifth slot therein transversely disposed thereto and in communication therewith and also providing a sixth slot therein, such that the third slot is in registry with the fifth slot when the second and third members are in telescopic sliding engagement and in the said extended position, and the second slot is in registry with the sixth slot when the first and third members are in telescopic sliding engagement and in the said extended position, the support having a pin locatable within the said first and second slots and within the said sixth slot for relative movement with the first and third members, wherein locating of the pin within the second and sixth slots and outside of the first slot maintains the first and third members in the said extended position thereof and locating of the pin within the first slot enables the first and third members to move from said extended position to said collapsed position, the support also having a pin locatable within the said fourth and fifth slots and within the said third slot for relative movement with the third and second members, wherein locating of the pin within the third and fifth slots and outside of the fourth slot maintains the third and second members in the said extended position thereof and locating of the pin within the fourth slot enables the third and second members to move from said extended position to said collapsed position.

In another aspect of the invention, a support comprises a means for attachment to a support beam.

In another aspect of the invention, the means for attachment is a horizontally disposed member for latching with a support beam.

In another aspect of the invention, a support comprises a horizontally disposed member which is supported by at least two vertically disposed support arms.

In another aspect of the invention, the support beam further comprises a notch having a least one edge and a mouth.

In another aspect of the invention at least one edge of the notch of the support beam is disposed at an angle that is not perpendicular to the length of the support beam.

In another aspect of the invention, the support further comprises a first attachment plate and a second attachment plate at the ends of the support beam.

In another aspect of the invention, at the least the first attachment plate or the second attachment plate comprise at least holes or notches.

In another aspect of the invention, a support may be attached to an elongate post.

In another aspect of the invention, a support further comprises a collar that surrounds both support members, said collar comprising diametrically opposed apertures through which the pin of the support member may be inserted.

In another aspect of the invention, where the support comprises two pins, there may be two collars comprising apertures such that each collar comprises a pair of apertures that may accommodate one pin.

In yet another aspect of the invention, there is a support beam comprising a notch having at least one edge and a mouth, said notch being operable with a connection means for supporting said support beam.

In yet another aspect of the invention, at least one edge of the notch in the support beam is disposed relative to the support beam at an angle other than perpendicular to the length of the support beam.

In yet another aspect of the invention, the connection means is a horizontally disposed bar for mating with the notch.

In yet another aspect of the invention, an edge of the horizontally disposed bar is rounded.

In yet another aspect of the invention, a support frame comprising at least one wall, said at least one wall comprising two substantially vertical sections joined by one substantially horizontal section is described.

In another aspect of the invention, the support frame further comprises a notch having at least one edge and a mouth, said notch being operable with a connection means for supporting said support frame.

In another aspect of the invention, the at least one wall of the support frame further comprises a base.

In another aspect of the invention, the at least one wall of the support frame further comprises a protuberance.

In another aspect of the invention, the support frame further comprises a cut out corner.

In another aspect of the invention, a support panel supportable by the support frame is described.

In another aspect of the invention, the support panel is made of plastic.

In another aspect of the invention, the support panel is made of a composite material.

In another aspect of the invention, the support frame is made of aluminium.

In yet another aspect of the invention, a beam comprising at least one edge, said at least one edge comprising two substantially vertical sections joined by one substantially horizontal section is described.

In another aspect of the invention, the beam further comprises a slot.

In another aspect of the invention, the beam further comprises a groove.

In yet another aspect of the invention, a support system comprising a beam comprising at least one edge, said at least one edge comprising two substantially vertical sections joined by one substantially horizontal section; and a support frame comprising at least one wall, said at least one wall comprising two substantially vertical sections joined by one substantially horizontal section is described.

In another aspect of the invention, in the support system, the beam further comprises a top, the support frame further comprises a base such that the substantially horizontal section of the beam supports the base of the support frame, and the top of the beam supports the substantially horizontal section of the support frame.

In another aspect of the invention, the support system further comprises gripping plates for fastening the support frame to the beam.

BRIEF DESCRIPTION OF THE DRAWINGS

The foregoing and other aspects of the invention will become more apparent from the following description of specific embodiments thereof and the accompanying drawings which illustrate, by way of example only, the principles of the invention. In the drawings.

DETAILED DESCRIPTION OF AN EMBODIMENT

Figure 1C:
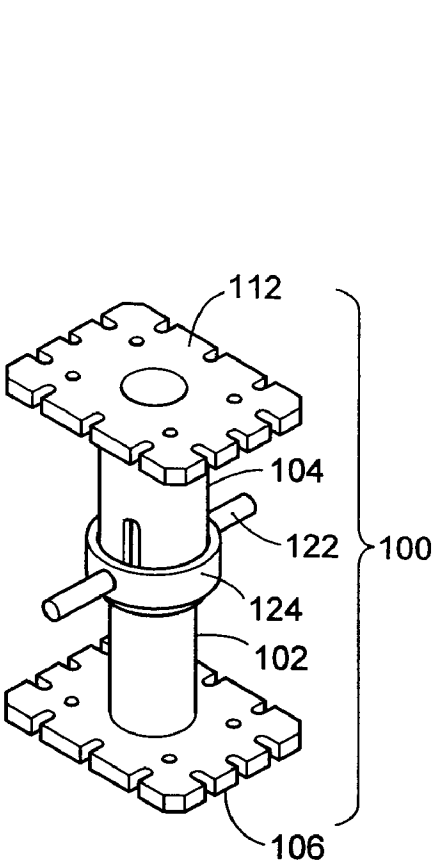
FIG. 1*c* is a front perspective view of the length-adjustable support of FIG. 1*a;*

The description which follows, and the embodiments described therein, are provided by way of illustration of an example, or examples, of particular embodiments of the principles of the present invention. These examples are provided for the purposes of explanation, and not limitation, of those principles and of the invention. In the description, which follows, like parts are marked throughout the specification and the drawings with the same respective reference numerals.

Figure 1B:
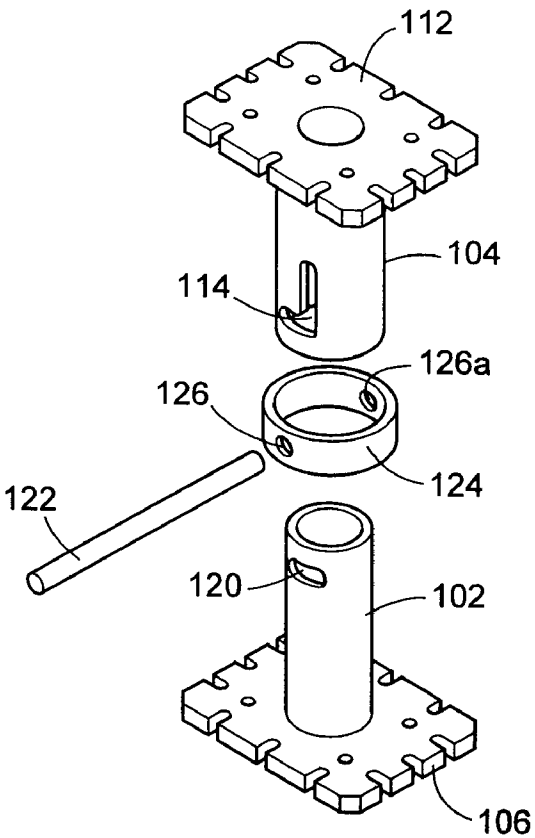
FIG. 1*b* is an exploded front perspective view of the length-adjustable support of FIG. 1*a;*
Figure 1A:
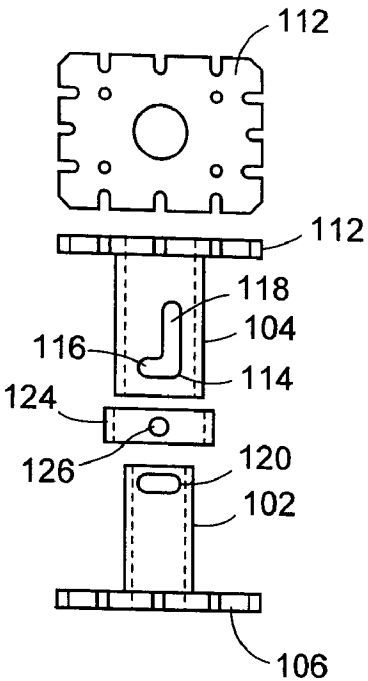
FIG. 1*a* is front view of a length-adjustable support, and a top view of said length-adjustable support.

FIGS. 1*a* to 1*c* show an embodiment of a length adjustable support in the form of a length-adjustable support 100 that is used is conjunction with scaffolding support post or other structural shoring member. In the embodiment shown, the support 100 comprises an inner post 102 and a hollow outer post 104. As shown in FIG. 1*a*, the diameter of the inner post 102 is less than the diameter of the outer post 104. Thus, the inner post 102 may slide telescopically within the outer post. In the embodiment shown, the posts are cylindrical in shape, but it will be appreciated that other shapes for the posts may also be employed, so long as the inner post is capable of sliding within the outer post. Inner post 102 may be hollow or solid, while outer post 104 must be hollow to allow inner post 102 to slide telescopically therethrough.

Outer post 104 has an aperture 114 that has a transverse aspect 116 and a longitudinal aspect 118, such that the aperture, for instance, is in the shape of the reverse of the capital letter 'L'. It will be appreciated that other shapes of aperture comprising both a predominantly transverse and predominantly longitudinal aspect may be employed in this embodiment and in the embodiments which follow herebelow. For example, an aperture with the shape of an upside down capital letter 'T' might also be employed. Inner post 102 has an aperture 120 that is generally complimentary in size and shape to the transverse aspect 116 of aperture 114. Although not shown in the figures, both the inner post 102 and the outer post 104 have identical apertures 120*a* and 114*a*, respectively, diametrically opposed to the apertures 120 and 114 previously described. When aperture 120 is aligned with the transverse aspect 116 of inner post 102, a pin 122 may pass through apertures 120 and 120*a* on the inner post 102, and through apertures 114 and 114*a* on the outer post. The pin 122, once inserted as aforesaid, restricts the longitudinal and concentric movement of inner post 102 relative to outer post 104. Without this restriction from pin 122, it will be appreciated that, in the particular configuration of FIG. 1, and if outer post 104 were disposed above inner post 102, gravity would urge outer post 104 to fall downward over inner post 102, and the outer post 104 would be free to rotate unimpeded about the inner post 102.

In the embodiment shown, pin 122 also may pass through apertures 126 and 126*a* in collar 124. The diameter of collar 124 is larger than the diameter of outer post 104, and collar 124 encircles outer post 104. Pin 122 is sufficiently long to allow both ends of pin 122 to protrude through apertures 126 and 126*a* when pin 122 is inserted therethrough.

A fully assembled support 100 with a pin 122 inserted through aperture 120 and the horizontal aspect 116 of aperture 114 is shown in FIG. 1*c*. Pin 122 may be moved transversely by a user transversely within transverse aspect 116 of aperture 114 toward longitudinal aspect 118. Once pin 122 is aligned within longitudinal aspect 118, and if outer post 104 were disposed above inner post 102, gravity will urge outer post 104 to move vertically downward until restricted by pin 122 contacting the topmost edge of longitudinal aspect 118.

It will be appreciated that pin 122 may bear considerable weight depending upon the structure that is supported by support 100. As such, pin 122 may require forceful impact, such as with a sledgehammer, in order to urge the pin 122 to move transversely. In addition, since pin 122 must support considerable weight, pin 122 may need to be constructed of a material that is capable of bearing considerable weight, such as, for example, steel or aluminium.

Pin 122 may be attached to collar 124 by way of welding or cotter pin and groove, or other attachment means, or pin 122 may rest freely within apertures 126 and 126*a*.

It will be appreciated that if aperture 114 is instead present in inner post 102, and if aperture 120 is present instead in outer post 104, the length-adjustable support 100 will function essentially the same as described above.

Figure 8:
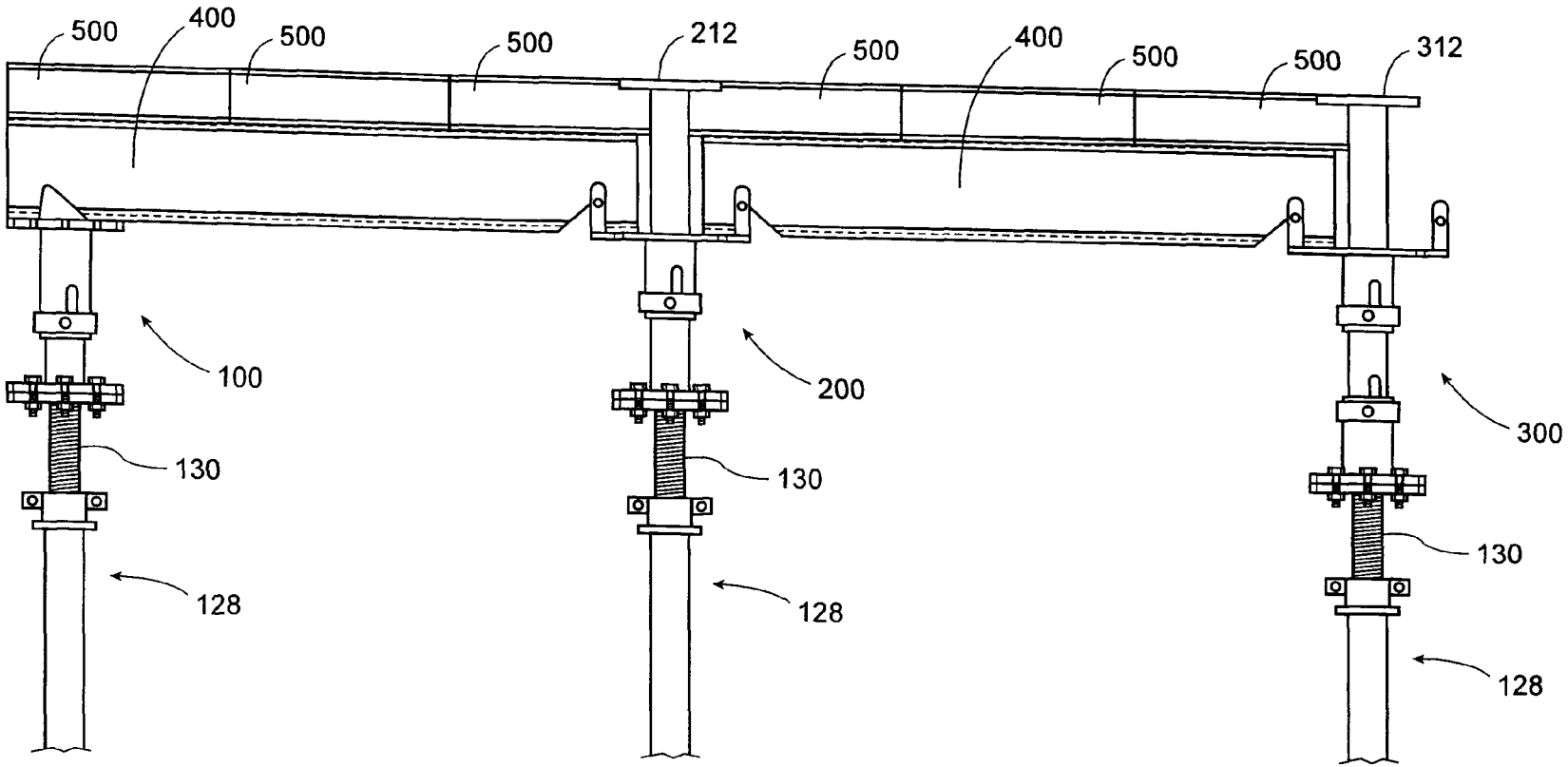
FIG. 8 is a front view of an assembled scaffolding assembly.

In the embodiment shown, inner post 102 is attached to a first attachment plate 106. Outer post 104 is attached to a second attachment plate 112. First attachment plate 106 and second attachment plate 112 have holes 108 and notches 110 therein. These holes 108 and notches 110 permit two or more length-adjustable supports 100 to be fastened to one another by inserting nuts and bolts, or other suitable connectors through holes 108 or notches 110 on two or more length-adjustable supports 100 or allow for a length-adjustable end piece 100 to be attached to other objects, for instance through corresponding holes or notches on, for example, the end of an elongate post member 128. FIG. 8 shows the first attachment plate 106 of length-adjustable support 100 attached to the end of an elongate post member 128 using nuts and bolts as aforesaid.

Elongate post member 128 may have screwjack 130 at one or both ends of the elongate post member 128 to allow for the length of elongate post member 128 to be adjusted. It will be appreciated, however, that elongate post member 128 may instead not have a means of adjusting height, such as a screwjack 130, or that elongate post member 128 may use a different means of adjusting height, such as telescoping sliding posts, or other means known in the art.

Figure 2C:
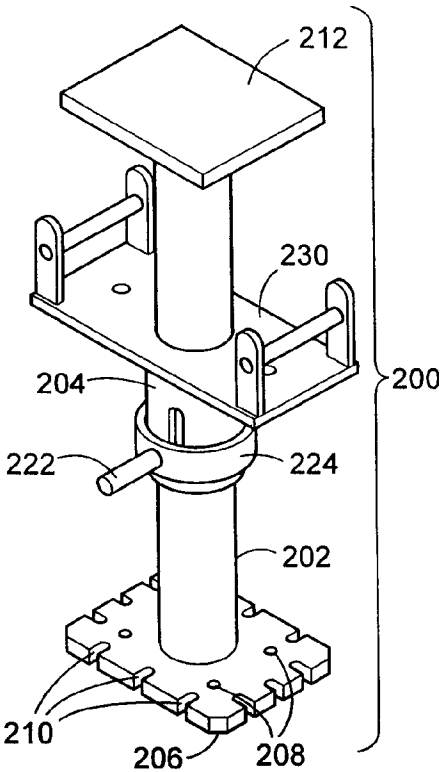
FIG. 2*c* is a front perspective view of the length-adjustable support of FIG. 2*a;*
Figure 2B:
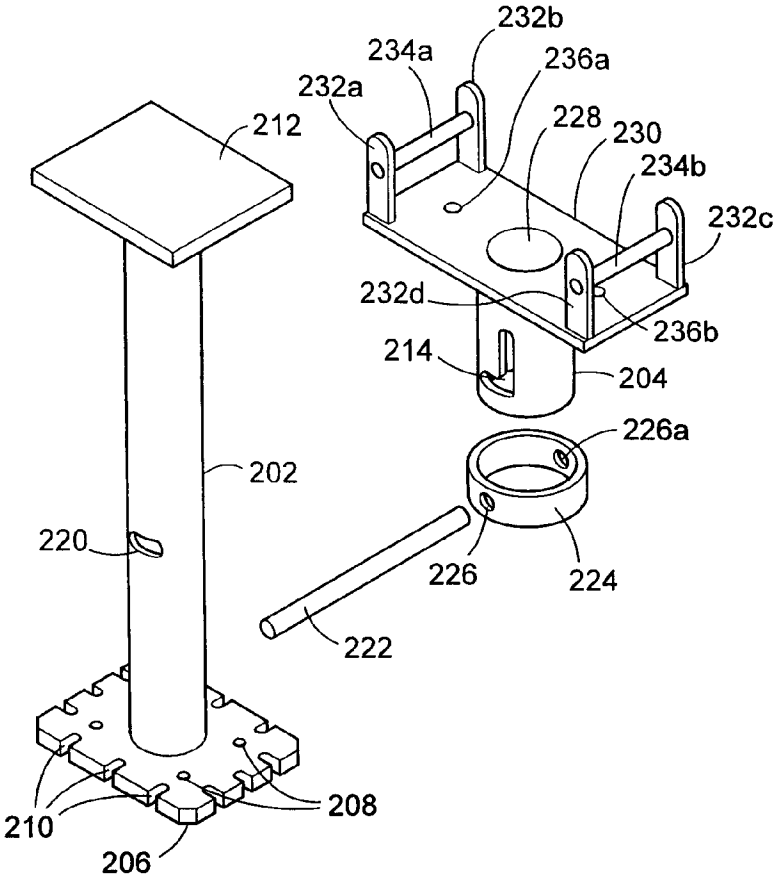
FIG. 2*b* is an exploded front perspective view of the length-adjustable support of FIG. 2*a;*
Figure 2A:
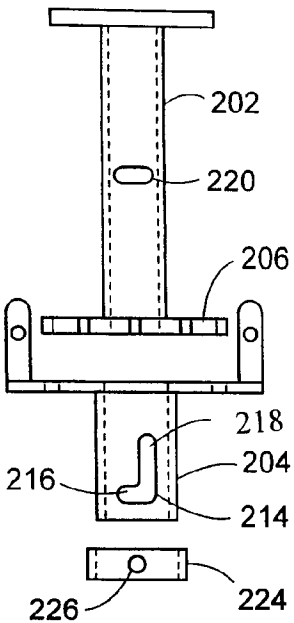
FIG. 2*a* is a front view of an alternate length-adjustable support.

Another embodiment of a length-adjustable support is length-adjustable support 200 shown at FIGS. 2*a* to 2*c*. In this length-adjustable support 200, there is an inner post 202, and an outer post 204. As shown in FIG. 2*a*, the diameter of the inner post 202 is less than the diameter of the outer post 204. Thus, the inner post 202 may slide telescopically within the outer post 204. In the embodiment shown, the inner post 202 and outer post 204 are cylindrical in shape, but it will be appreciated that other shapes for the posts may also be employed, so long as the inner post is capable of sliding within the outer post. Inner post 202 may be hollow or solid, while outer post 204 must be hollow to allow inner post 202 to slide telescopically therethrough.

Outer post 204 has an aperture 214 that has a transverse aspect 216 and a longitudinal aspect 218, such that the aperture 214, for instance, is in the shape of the reverse of the capital letter 'L'. It will be appreciated that other shapes of aperture comprising both a predominantly transverse and predominantly longitudinal aspect may be employed in this embodiment and in the embodiments which follow herebelow. For example, an aperture with the shape of an upside down capital letter 'T' might also be employed. Inner post 202 has an aperture 220 that is generally complimentary in size and shape to the transverse aspect 216 of aperture 214. Although not shown in the figures, both the inner post 202 and the outer post 204 have identical apertures 220*a* and 214*a*, respectively, diametrically opposed to the apertures 220 and 214 previously described. When aperture 220 is aligned with the transverse aspect 216 of inner post 202, a pin 222 may pass through apertures 220 and 220*a* on the inner post 202, and through 214 and 214*a* on the outer post. The pin 222, once inserted as aforesaid, restricts the longitudinal and concentric movement of inner post 202 relative to outer post 204. Without this restriction from pin 222, it will be appreciated that, in the particular configuration of FIG. 1, and if outer post 204 were disposed above inner post 202, gravity would urge outer post 204 to fall downward over inner post 202, and the outer post 204 would be free to rotate unimpeded about the inner post 202.

In the embodiment shown, pin 222 also may pass through apertures 226 and 226*a* in collar 224. The diameter of collar 224 is larger than the diameter of outer post 204, and collar 224 encircles outer post 204. Pin 222 is sufficiently long to allow both ends of pin 222 to protrude through apertures 226 and 226*a* when pin 222 is inserted therethrough.

Outer post 204 is attached to platform 230 at and end of outer post 204. Platform 230 has a central opening 228 through which inner post 202 passes when inner post 202 is slidably engaged within outer post 204. Support arms 232*a*, 232*b*, 232*c* and 232*d* are fixed to opposite sides of platform 230. Retaining bar 234*a* is held between support arms 232*a* and 232*b*. Similarly, retaining bar 234*b* is held between support arms 232*c* and 232*d*.

Figure 4B:
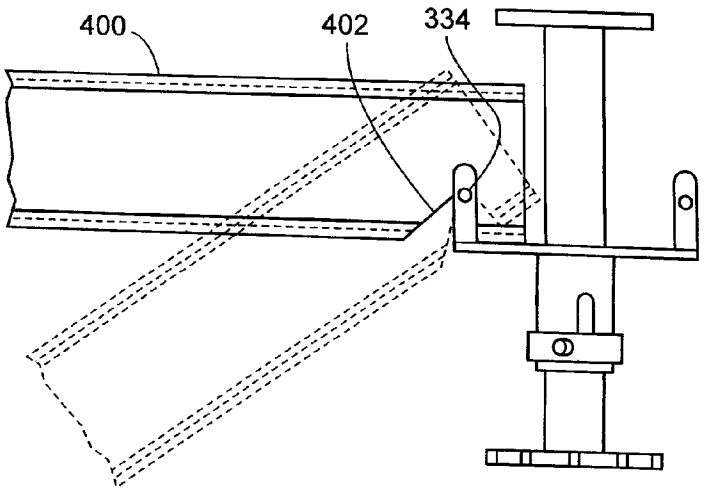
FIG. 4*b* is a front view of the support member of FIG. 4*a* and the length-adjustable support of 2*a*, showing a second position of the support member in stippled lines.
Figure 4C:
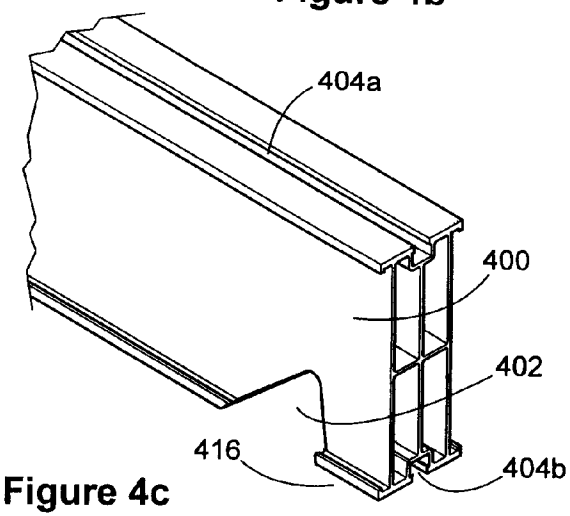
FIG. 4*c* is a perspective view of the support member of FIG. 4*a;*

As explained more fully below, each of retaining bars 234*a* and 234*b* is adapted to fit within notch 402 on support member 400 (see FIG. 4). Notch 402 may be angled to allow for support member 400 to rotate about the retaining bars 234*a* or 234*b*, as shown in FIG. 4*c*.

In one embodiment, there may be a connection hole 236*a* located between central opening 228 and support arms 232*a* and 232*b*. There may also be a connection hole 236*b* located between central opening 228 and support arms 232*c* and 232*d*. These connection holes 236*a* and 236*b* permit support member 400 to be attached to platform 230 by way of bolts, or other suitable connectors.

It will be appreciated that more than two such connection holes may be used in platform 230 to assist in attaching support member 400 to platform 230.

A fully assembled support 200 with a pin 222 inserted through aperture 220 and the transverse aspect 216 of aperture 214 is shown in FIG. 1*c*. Pin 222 may be moved transversely by a user within transverse aspect 216 of aperture 214 toward longitudinal aspect 218. Once pin 222 is aligned within longitudinal aspect 218, and if outer post 204 were disposed above inner post 202, gravity will urge outer post 204 to move vertically downward until restricted by pin 222 contacting the topmost edge of longitudinal aspect 218.

It will be appreciated that if aperture 214 is instead present in inner post 202, and if aperture 220 is present in outer post 204, the length-adjustable support 200 will function essentially the same as described above.

In the embodiment shown, inner post 202 is attached to a first attachment plate 206 and a second attachment plate 212. First attachment plate 206 has holes 208 and notches 210 therein. These holes 208 and notches 210 permit two or more length-adjustable supports 200 to be fastened to one another by inserting nuts and bolts, or other suitable connectors through holes 208 or notches 210 on two or more length-adjustable supports 200 or allow for a support 200 to be fastened to other objects, through similar holes or notches on, for example, the end of an elongate post member 128. FIG. 8 shows the first attachment plate 206 of length-adjustable end piece 200 attached to the end of an elongate post member 128 using nuts and bolts as aforesaid. Although no holes or notches are shown in second attachment plate 212, it will be appreciated that second attachment plate 212 may comprise holes or notches, and that these holes or notches in second attachment plate 212 may be used to facilitate attachment to first attachment plate 206 or second attachment plate 212 of a second support 200 or to another object, such as an elongate post member 128.

It should be noted that although FIG. 2 shows first attachment plate 206 and second attachment plate 212 attached to inner post 202, that at least one of first attachment plate 206 and second attachment plate 212 may be attached to inner post 202 only after inner post 202 has been inserted through central opening 228 in platform 230 and also through outer post 204.

It will be appreciated that pin 222 may bear considerable weight depending upon the structure that is supported by support 200. As such, pin 222 may require forceful impact, such as with a sledgehammer, in order to urge the pin 222 to move transversely. In addition, since pin 222 must support considerable weight, pin 222 may need to be constructed of a material that is capable of bearing such weight, such as, for example, steel or aluminium.

Pin 222 may be attached to collar 224 by way of welding or cotter pin and groove, or other attachment means, or pin 222 may rest freely within apertures 226 and 226*a*.

Figure 3A:
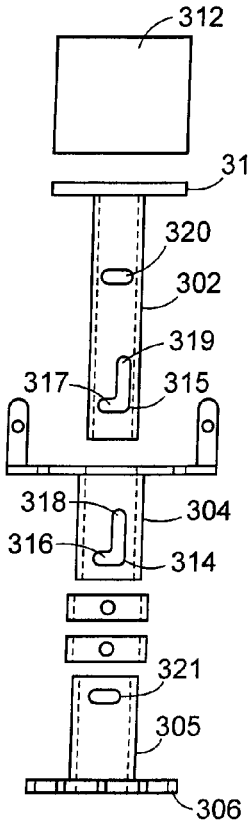
FIG. 3*a* is front view of a length-adjustable support, and a top view of said length-adjustable support.
Figure 3B:
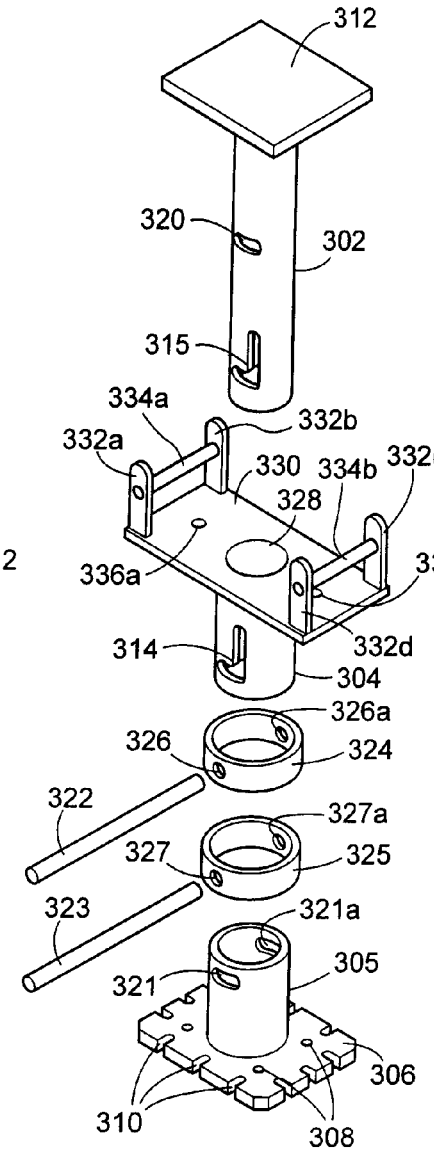
FIG. 3*b* is an exploded front perspective view of the length-adjustable support of FIG. 3*a;*
Figure 3C:
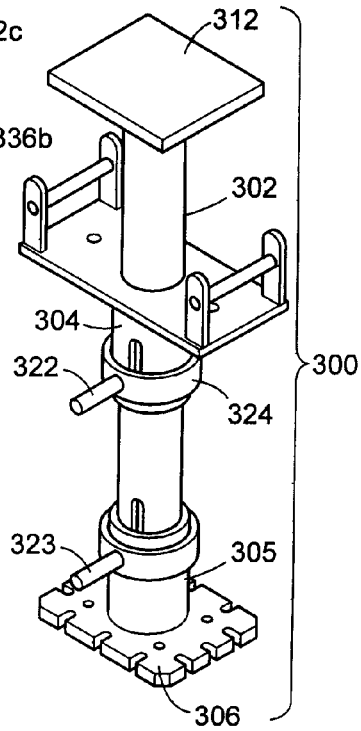
FIG. 3*c* is a front perspective view of the length-adjustable support of FIG. 3*a;*

Another embodiment of a length-adjustable support is length-adjustable support 300 shown at FIGS. 3*a* to 3*c*. In this length-adjustable support 300, there is an inner post 302, an outer post 304, and a second outer post 305. As shown clearly in FIG. 3*a*, the diameter of the inner post 302 is less than the diameter of the outer post 304 and the second outer post 305. In the embodiment shown in FIG. 3, the diameter of the outer post 304 and second outer post 305 are equal. Thus, the inner post 302 may slide telescopically within both the outer post 304 and second outer post 305. In the embodiment shown, the inner post 302, outer post 304 and second outer post 305 are cylindrical in shape, but it will be appreciated that other shapes for the posts may also be employed, so long as the inner post is capable of sliding within the outer post 304 and second outer post 305. Inner post 302 may be hollow or solid, while outer post 304 and second outer post 305 must be hollow to allow inner post 302 to slide telescopically therethrough.

Outer post 304 has an aperture 314 that has a transverse aspect 316 and a longitudinal aspect 318, such that the aperture is in the shape of the reverse of the capital letter 'L'. Similarly, inner post 302 has an aperture 315 that has a transverse aspect 317 and a longitudinal aspect 319, such that the aperture is in the shape of the reverse of the capital letter 'L'. It will be appreciated that other shapes of aperture comprising both a predominantly transverse and predominantly longitudinal aspect may be employed in this embodiment and in the embodiments which follow. For example, an aperture with the shape of an upside down capital letter 'T' might also be employed. In addition, inner post 302 has an aperture 320 that is complimentary in size and shape to the transverse aspect 316 of aperture 314, and which is located above aperture 315 on inner post 302, where inner post 302 is oriented specifically as in the embodiment illustrated in FIG. 3. Furthermore, second outer post 305 has an aperture 321 that is complimentary in size and shape to the transverse aspect 317 of aperture 315. Although not shown in the figures (with the exception of 321*a*, which is shown in FIG. 3*b*), inner post 302, outer post 304, and second outer post 305 have identical apertures 320*a* and 315*a*; 314*a*; and 321*a*, respectively, diametrically opposed apertures 320, 315, 314 and 321 previously described. When aperture 320 is aligned with the transverse aspect 316 of aperture 314 in outer post 304, a pin 322 may pass through apertures 320 and 320*a* on the inner post 302, and through apertures 314 and 314*a* on the outer post 304. When aperture 321 is aligned with the transverse aspect 317 of aperture 315 in inner post 302, a pin 323 may pass through apertures 321 and 321*a* on the second outer post 305, and through apertures 315 and 315*a* on the inner post 302.

Pin 322, once inserted as aforesaid, restricts the longitudinal and concentric movement of outer post 304 relative to inner post 302. Without this restriction from pin 322, it will be appreciated, in the particular configuration of FIG. 3, and if outer post 304 were disposed above inner post 302, that gravity would urge outer post 304 to fall downward over inner post 302 and the outer post 304 would be free to rotate unimpeded about inner post 302. Pin 323, once inserted as aforesaid, restricts the longitudinal and concentric movement of inner post 302 relative to second outer post 305. Without this restriction from pin 323, it will be appreciated, in the particular configuration of FIG. 3, and if second outer post 305 were disposed above inner post 302, that gravity would urge inner post 302 to fall downward within second outer post 305 and the second outer post 305 would be free to rotate unimpeded about inner post 302.

In the embodiment shown, pin 322 also may pass through apertures 326 and 326*a* in collar 324. The diameter of collar 324 is larger than the diameter of outer post 304, and collar 324 encircles outer post 304. Pin 322 is sufficiently long to allow both ends of pin 322 to protrude through apertures 326 and 326*a* when pin 322 is inserted therethrough.

In the embodiment shown, pin 323 also may pass through apertures 327 and 327*a* in collar 325. The diameter of collar 325 is larger than the diameter of second outer post 305, and collar 325 encircles second outer post 305. Pin 323 is sufficiently long to allow both ends of pin 323 to protrude through apertures 327 and 327*a* when pin 323 is inserted therethrough.

An end of outer post 304 is attached to platform 330. Platform 330 has a central opening 328 through which inner post 302 passes when inner post 302 is slidably engaged within outer post 304. Support arms 332*a*, 332*b*, 332*c* and 332*d* are fixed to opposite sides of platform 330. Retaining bar 334*a* is held between support arms 332*a* and 332*b*. Similarly, retaining bar 334*b* is held between support arms 332*c* and 332*d*.

A fully assembled support 300 with pin 322 inserted through apertures 320, 326 and the transverse aspect 316 of aperture 314 is shown in FIG. 2*c*. Similarly, pin 323 is inserted through apertures 327, 321 and the transverse aspect 317 of aperture 315. As in the examples noted above, if pin 322 is moved transversely by a user to align with the longitudinal aspect 318 of aperture 314, in the particular configuration of FIG. 3, and if outer post 304 were disposed above inner post 302, outer post 304 will be urged vertically downward by gravity over inner post 302 until restricted by pin 322 contacting the topmost edge of longitudinal aspect 318. Similarly, if a user moves pin 323 transversely until aligned with the vertical aspect 319 of aperture 315, in the particular configuration of FIG. 3, and if second outer post 305 were disposed above inner post 302, inner post 302 will be urged downward within second outer post 305 by gravity until the pin 323 contacts the topmost edge of longitudinal aspect 319.

In the embodiment shown, second outer post 305 is attached to a first attachment plate 306. First attachment plate 306 has holes 308 and notches 310 therein. These holes 308 and notches 310 permit two or more length-adjustable supports 300 to be fastened to one another by inserting nuts and bolts, or other suitable connectors through holes 308 or notches 310 on two or more length-adjustable supports 300, or allow for a support 300 to be fastened to other objects, through similar holes or notches on, for example, the end of an elongate post member 128. FIG. 8 shows the first attachment plate 306 of length-adjustable end piece 300 attached to the end of an elongate post member 128 using nuts and bolts. A second attachment plate 312 is attached to the end of inner post 302. Although no holes or notches are shown in second attachment plate 312, it will be appreciated that second attachment plate 312 may comprise holes and/or notches, and that these holes or notches in second attachment plate 312 may be used to facilitate attachment to first attachment plate 306 or second attachment plate 312 of a second end piece 300 or to another object, such as an elongate post member 128.

It will be appreciated that pins 322 and 323 may bear considerable weight depending upon the structure that is supported by support 300. As such, pins 322 and 323 may require forceful impact, such as with a sledgehammer, in order to urge the pins 322 and 323 to move transversely. In addition, since pins 322 and 323 must support considerable weight, pins 322 and 323 may need to be constructed of a material that is capable of bearing considerable weight, such as steel or aluminium, for example.

Pins 322 and 323 may be attached to collars 324 and 325, respectively, by way of welding or cotter pin and groove, or other attachment means, or pins 322 and 323 may rest freely within apertures 326 and 326*a*, and apertures 327 and 327*a*, respectively.

It will be appreciated that apertures 314, 315, 320 and 321 may be interchanged between the inner post 302 the outer post 304 and the second outer post 305, so long as each aperture comprising both a transverse and a longitudinal aspect may be in registry with an aperture having only a transverse aspect.

It will be appreciated that in other embodiments of length-adjustable support 300, the diameter of outer post 304 and second outer post 305 may differ such that the outer post 304 and second outer post 305 may slide telescopically relative to one another.

In another embodiment of length-adjustable support 300, instead of two outer posts and one inner post, as described length-adjustable support 300 may comprise two inner posts and one outer post. In such an embodiment, the outer post would need to be hollow to allow the two inner posts to slide telescopically therethrough.

As indicated above, each of retaining bars 234*a* and 234*b* is adapted to fit within a notch 402 on support member 400. Similarly, each of retaining bars 334*a* and 334*b* is adapted to fit within notch 402 on support member 400. Support member 400 is a beam for deployment between adjacent post members 128. Support member 400 may comprise one or more notches 402. The notches 402 may be triangular in shape, as shown in FIG. 4, although it will be appreciated that other shapes of notches 402 may also be used, so long as retaining bars 234*a* and 234*b* and 334*a* and 334*b* are capable of fitting within notches 402. It should be noted that notch 402 may be displaced some distance from the end of support member 400. This may produce an end portion 416 of support member 400. This end portion 416 may rest against platforms 230 and 330, providing further support for support member 400. It will be appreciated that, in some embodiments, end portion 416 may not rest against platforms 230 and 330, since this may provide additional space for support member 400 to rotate about the retaining bars.

Each of retaining bars 334*a* and 334*b* is adapted to fit within notch 402 on support member 400. One or more walls of notch 402 may be angled to facilitate rotation of support member 400 about retaining bar 334, as shown in FIG. 4. Thus, when retaining bars 334*a* and 334*b* are raised and lowered along with length-adjustable support 300, support members 400 may rotate around retaining bars 334*a* and 334*b* as need dictates. The angle of a wall of notch 402 also facilitates mating of notch 402 with retaining bar 334, since a user can be situated below retaining bar 334 of an assembled shoring assembly and may still mate notch 402 with said retaining bar 334. This aforementioned rotation and mating may also be accomplished with notches of a different shape, but it will be appreciated that a wide mouth for the notch, and an angled notch facilitate both mating and rotation. Although the interrelationship between support member 400 and retaining bar 334 has been discussed with respect to length-adjustable support 300, it will be appreciated that a similar interrelationship exists between support member 400 and retaining bar 234 of length-adjustable support 200.

In one embodiment, there may be a connection hole 336*a* located between central opening 328 and support arms 332*a* and 332*b*. There may also be a connection hole 336*b* located between central opening 328 and support arms 332*c* and 332*d*. These connection holes 336*a* and 336*b* permit support member 400 to be attached to platform 330 by way of bolts, or other suitable connectors.

It will be appreciated that more than two connection holes may be used in platform 330 to assist in attaching support member 400 to platform 330.

It will be appreciated that the different embodiments of the length-adjustable supports described above may be used together in combination in the same shoring assembly. By way of example, FIG. 8 illustrates a shoring assembly wherein each of length-adjustable supports 100, 200 and 300 are utilized.

As shown in FIG. 8, it will be appreciated that length-adjustable support 100 is capable of supporting support member 400 without the use of the retaining bars of length-adjustable supports 200 and 300. In this situation, support member 400 may simply rest upon second attachment plate 112 of support 100.

U-shaped channels 404*a* and 404*b* run longitudinally along the centre of first edge 406*a* and second edge 406*b*, respectively, of support member 400. First edge 406*a* extends beyond walls 408*a* and 408*b* of support member 400, and terminates at lip 410*a* located at each end of first edge 406*a*. Lip 410*a* depends perpendicularly from first edge 406*a* toward the second edge 406*b* of support member 400. Likewise, second edge 406*b* extends beyond walls 408*a* and 408*b* of support member 400, and terminates at each end of second edge 406*b* with lip 410*b*. Lip 410*b* depends perpendicularly from second edge 406*b* toward the first edge 406*a* of support member 400.

Figures 5, 5A:
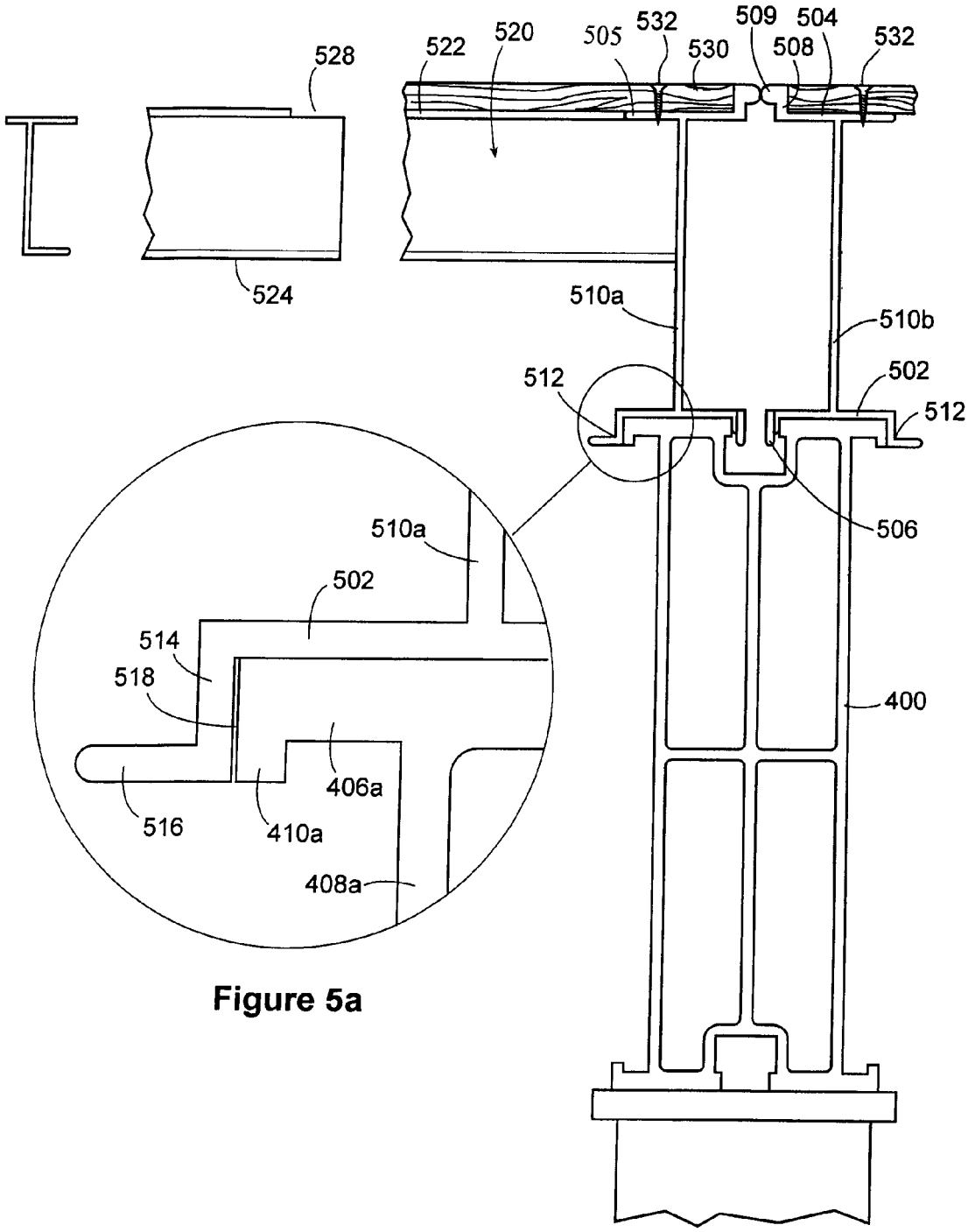
FIG. 5 is an end view of the support member of FIG. 4*a*, an end view of a ledger beam, and a side view of sections of a waler.
FIG. 5*a* is an enlarged view of the circled area of FIG. 5.

Turning to FIG. 5, ledger beams 500*a* and 500*b* may be supported by support member 400 by placing ledger beams 500*a* and 500*b* against support member 400. Each ledger beam 500 has wall 510, second edge 502 and first edge 504. First ridge 508 depends perpendicularly from first edge 504, and runs longitudinally along a section of first edge 504. Second ridge 506 depends perpendicularly from second edge 502 and runs longitudinally along a section of second edge 502. First edge 504 may extend beyond wall 510, forming ledger ledge 505. First ridge 508 has a head 509 extending perpendicularly therefrom and away from wall 510.

Second ridge 506 fits within U-shaped channel 404*a* in the first edge 406*a* of support member 400. As such, it will be apparent that two ledger beams 500 may be supported in a side-by-side arrangement on support member 400, as the U-shaped channel 404*a* is wide enough to accommodate two second ridges 506, as shown in FIG. 5. When the second ridges 506 of two ledger beams 500 are inserted within U-shaped channel 404*a* as aforesaid, heads 509 of each of the two ledger beams 500 abut one another. Second edge 502 extends beyond wall 510 of ledger beam 500. Second edge 502 terminates with lip 512. Lip 512 comprises an arm 514 and a flange 516. Arm 514 depends perpendicularly from second edge 502 away from first edge 504. Flange 516 depends perpendicularly from arm 514 away from wall 510.

It will be appreciated that more than two ledger beams 500 may be supported by a single support member 400, where multiple ledger beams 500 are placed upon support member 400 longitudinally in end-to-end relation with one another.

When second ridge 506 of ledger beam 500 is inserted within U-shaped channel 404*a*, arm 514 extends at least the length of lip 410*a* on support member 400. The distance between the two lips 410*a* on support member 400 is less than the distance between one arm 514 on a first ledger beam 500, and between a second arm 514 on a second ledger beam 500, where the second ridges 506 of said first and second ledger beams 500 are inserted within U-shaped channel 404*a* such that the first and second ledger beams 500 rest in a side-by-side configuration against support member 400. As such, second edge 502 of ledger beam 500 may rest against first edge 406*a* of support member 400 when second ridge 506 of ledger beam 500 is inserted within U-shaped channel 404*a*.

There may be a gap 518 between arm 514 and lip 410*a*. This gap 518 defines a tolerance that allows for potential expansion or contraction of support member 400 and/or ledger beam 500 due to temperature changes. This gap 518 also allows for some movement of ledger beam 500 relative to support member 400, which facilitates disengagement of ledger beam 500 from support member 400 and, similarly, facilitates engagement of ledger beam 500 with support member 400.

Figures 9, 9A:
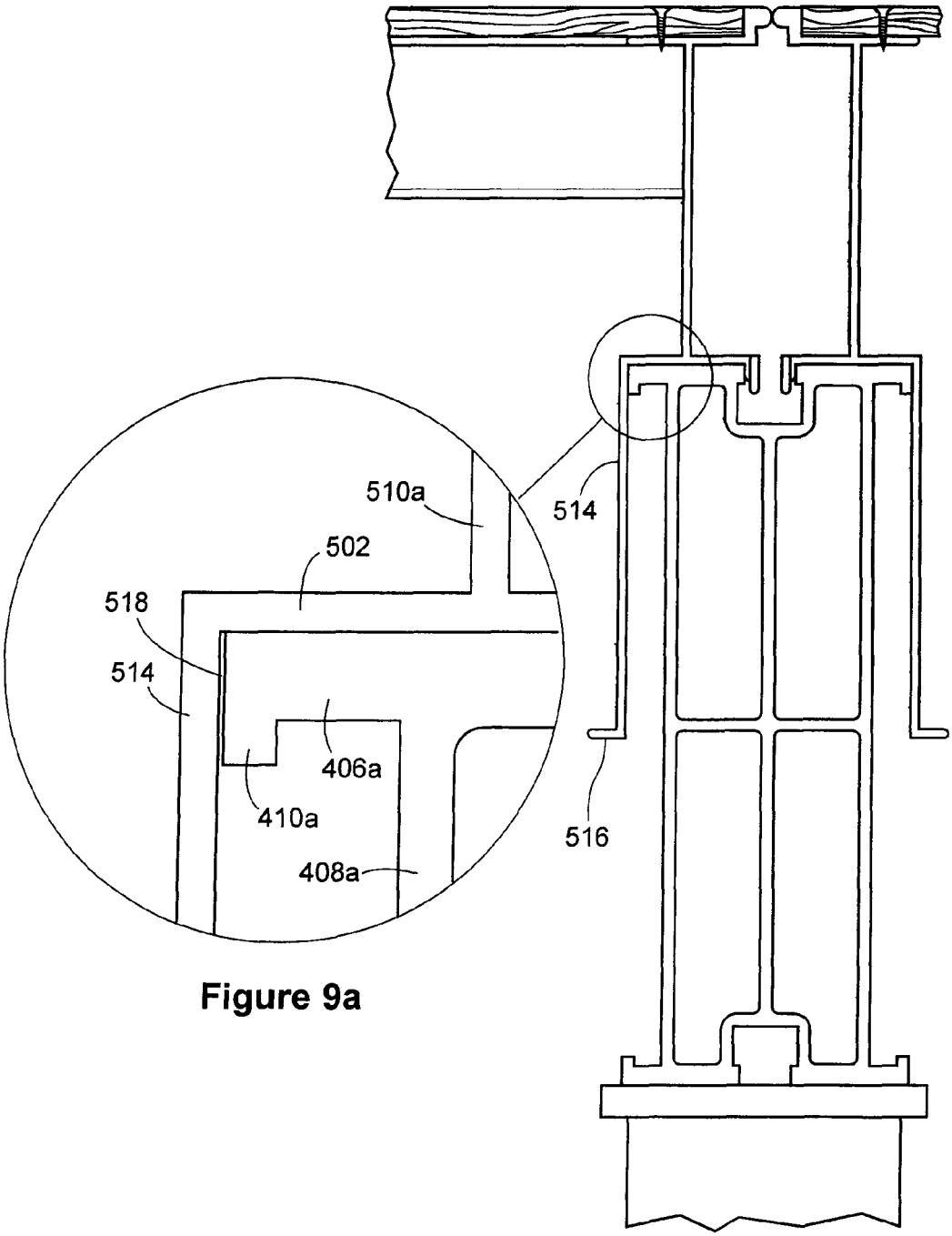
FIG. 9 is an end view of the support member of FIG. 4*a*, an end view of an alternate embodiment of the ledger beam of FIG. 5, and a side view of a portion of a waler.
FIG. 9*a* is an enlarged view of the circled area of FIG. 9.

While arm 514 is preferably at least the length of lip 410*a* to ensure proper support of ledger beams 500 by support member 400, arm 514 may be longer than lip 410*a*, which may facilitate mating between ledger 500 and support member 400, and which may lessen the chance that ledger beams 500 could become accidentally disengaged from support member 400. An alternate embodiment of ledger beams 500 with long arms 514 is illustrated in FIGS. 9 and 9*a*. The longer arms 514 of this alternate embodiment increase the stiffness of ledger beams 500. As the length of ledger beams 500 increases, some bending or deformation of ledger beams 500 may occur. Longer arms 514 have been found to decrease this bending or deformation.

Figure 6:
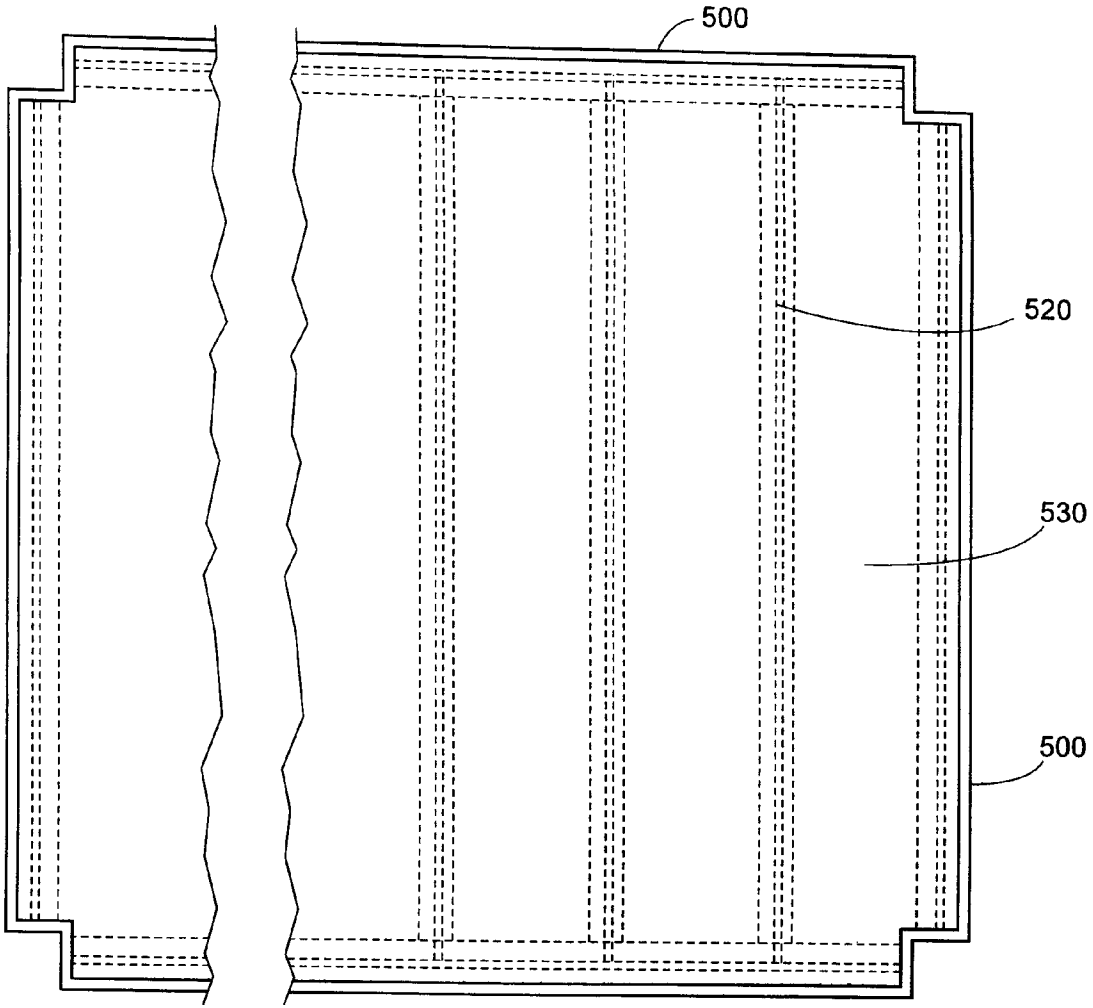
FIG. 6 is a top view of one panel of an assembled box form.
Figure 6A:
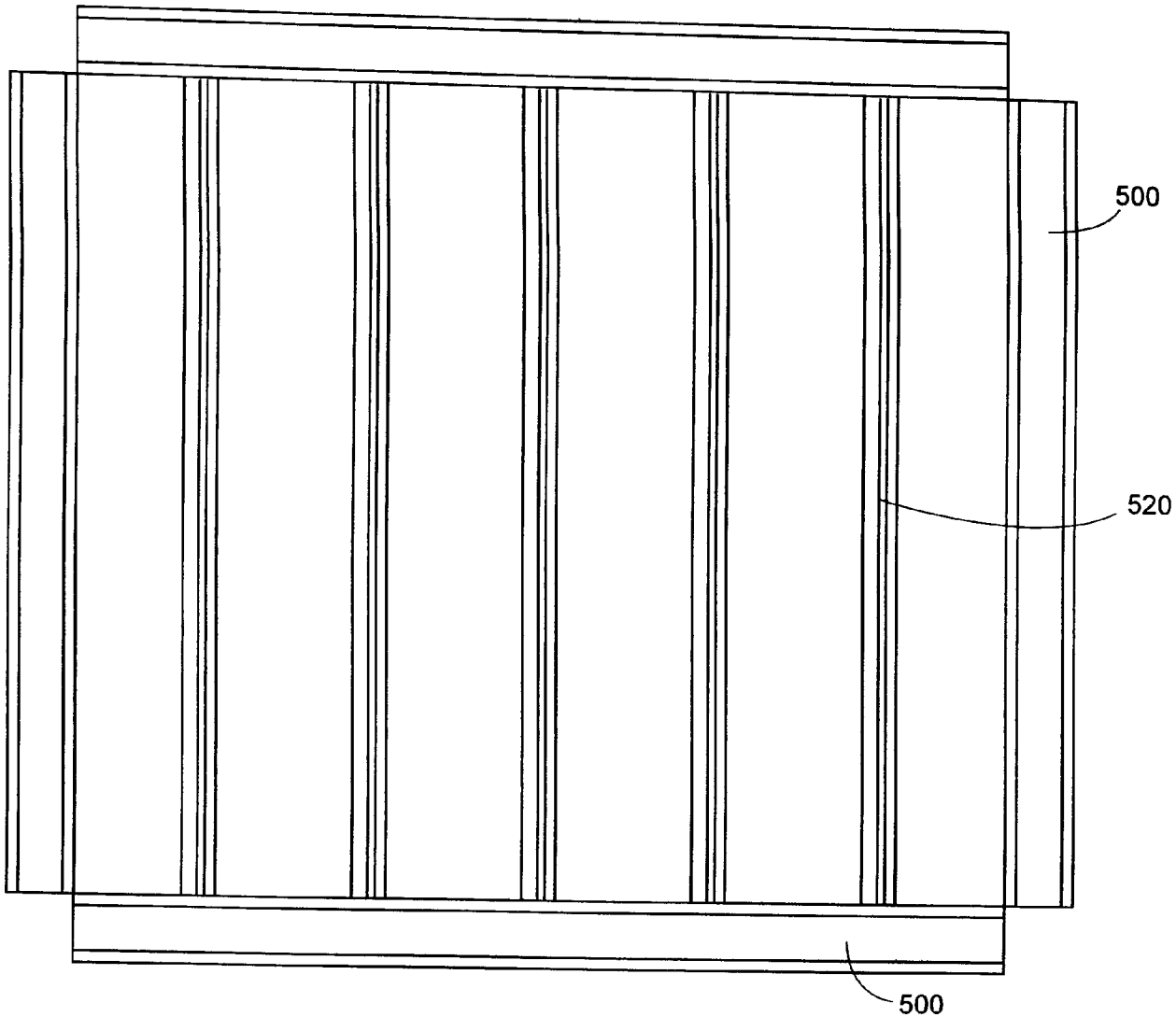
FIG. 6*a* is a bottom view of one panel of an assembled box form showing notches in the bottom corners.

Ledger beams 500 may be attached to one another to create forms. For example, four ledger beams 500 may be attached to one another to form a rectangle, as shown in FIG. 6. Ledger beams may be attached to one another by welding, for example, or by other suitable means. Ledger beams 500 may further be attached to one or more walers 520. The walers 520 may be made of aluminium, or other suitable materials. Walers 520 may be attached by welding, or by other suitable means. Walers 520 attached to ledger beams 500 may be positioned perpendicular to the walls 510*a* and 510*b* of ledger beam 500, although being positioned perpendicularly to the ledger beams 500 is not essential. It will be appreciated that walers 520 may also be positioned at an angle to ledger beams 500. Each waler 520 has first edge 522 and second edge 524 which run longitudinally along the waler 520. First edge 522 does not run the entire length of waler 520 due to void 528 which is present at each end of waler 520. When waler 520 rests against a wall 510 of ledger beam 500, ledger ledge 505 may be interlocked with void 528.

In the particular embodiment shown in FIG. 6, ledger beams 500 form the perimeter of a rectangle. Walers 520 are attached to two opposite ledger beams 500, and may extend between the two opposing ledger beams 500, and across the rectangle. These walers 520 provide additional support for a contact surface 530, described below.

Figure 6B:
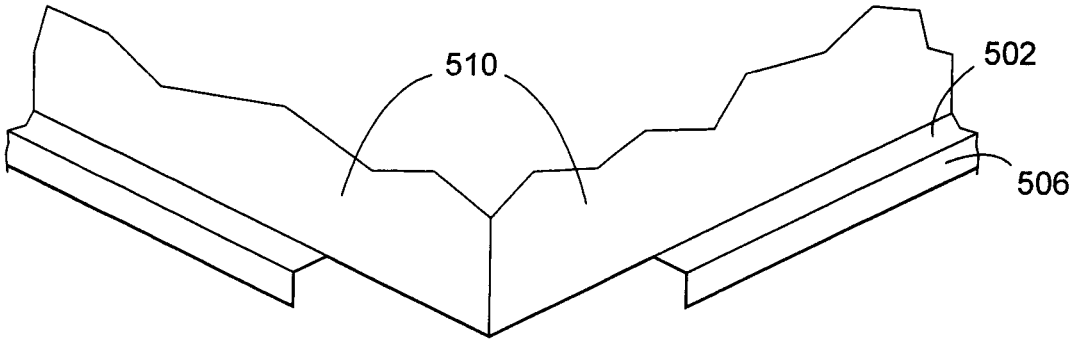
FIG. 6*b* is a perspective view of portion of a corner of the box form bordered by ledger beams.

As shown in FIG. 6*b*, a portion of second edge 502 and second ridge 506 may be cut away at the corners of the boxes formed by ledger beams 500 to allow wall 510 of ledger beams 500 that run perpendicular to support members 400 to rest against first edge 406*a* of support member 400. Although not shown, it will be appreciated that a portion of arm 512 may also need to be cut away at the corners of the boxes formed by ledger beams 500 to allow wall 510 of ledger beams 500 that run perpendicular to support members 400 to rest against first edge 406*a* of support member 400.

Figure 4A:
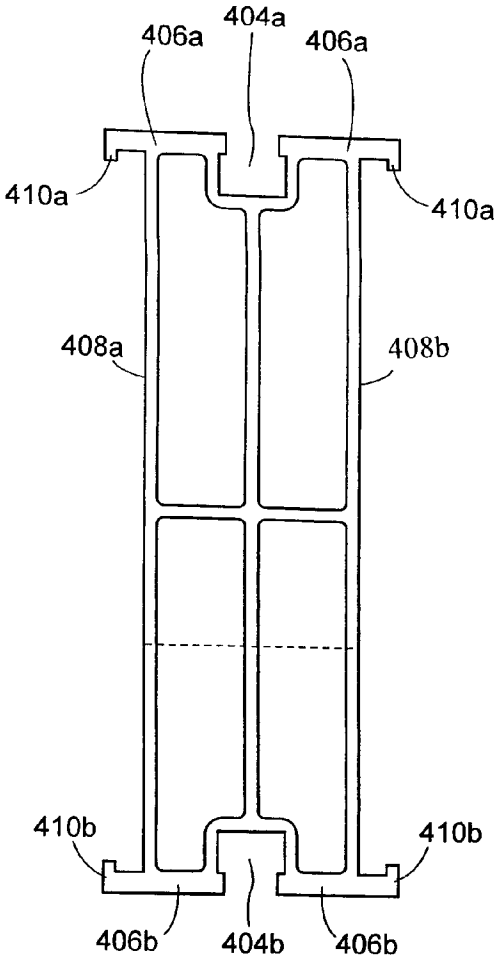
FIG. 4*a* is an end view of a support member.
Figure 4E:
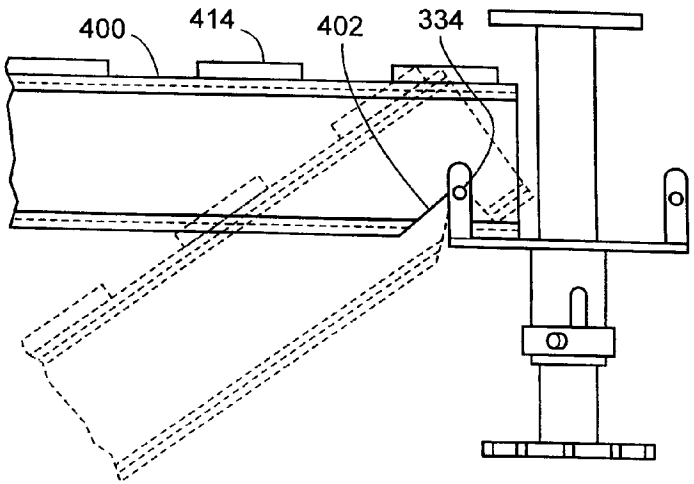
FIG. 4*e* is a front view of the support member of FIG. 4*d* and the length-adjustable support of 2*a*, showing a second position of the support member in stippled lines.
Figure 4F:
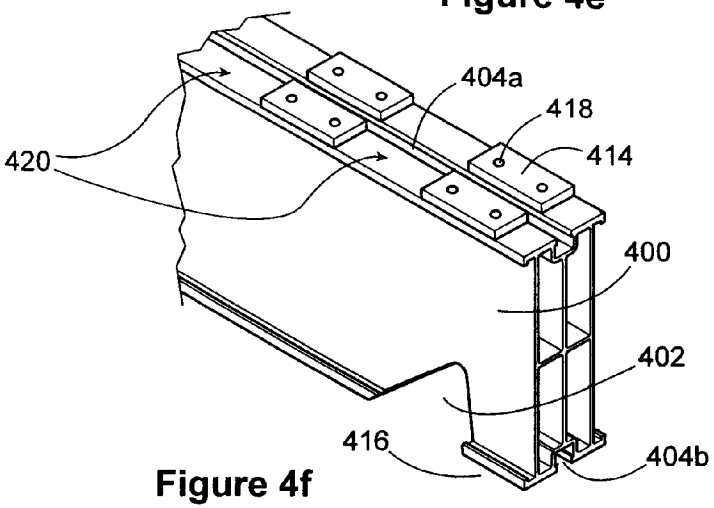
FIG. 4*f* is a perspective view of the support member of FIG. 4*d;*
Figure 4D:
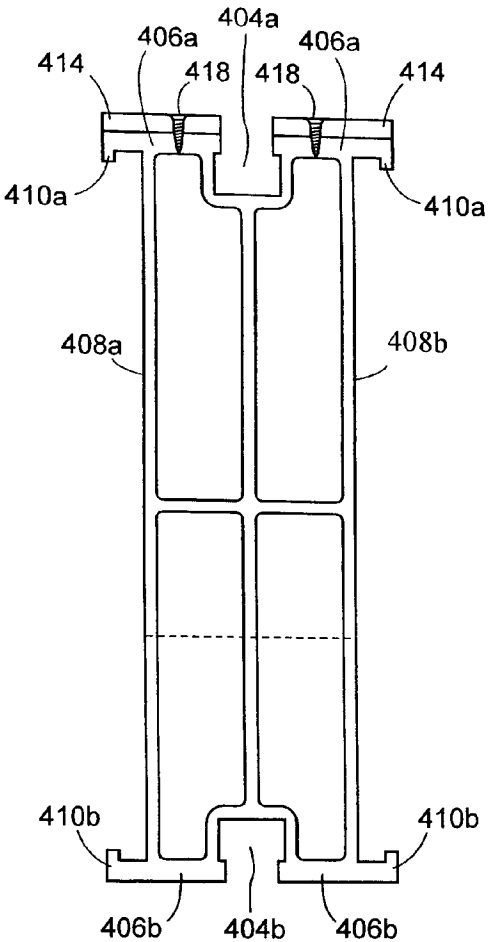
FIG. 4*d* is an end view of a support member showing stoppers attached thereto.
Figure 5B:
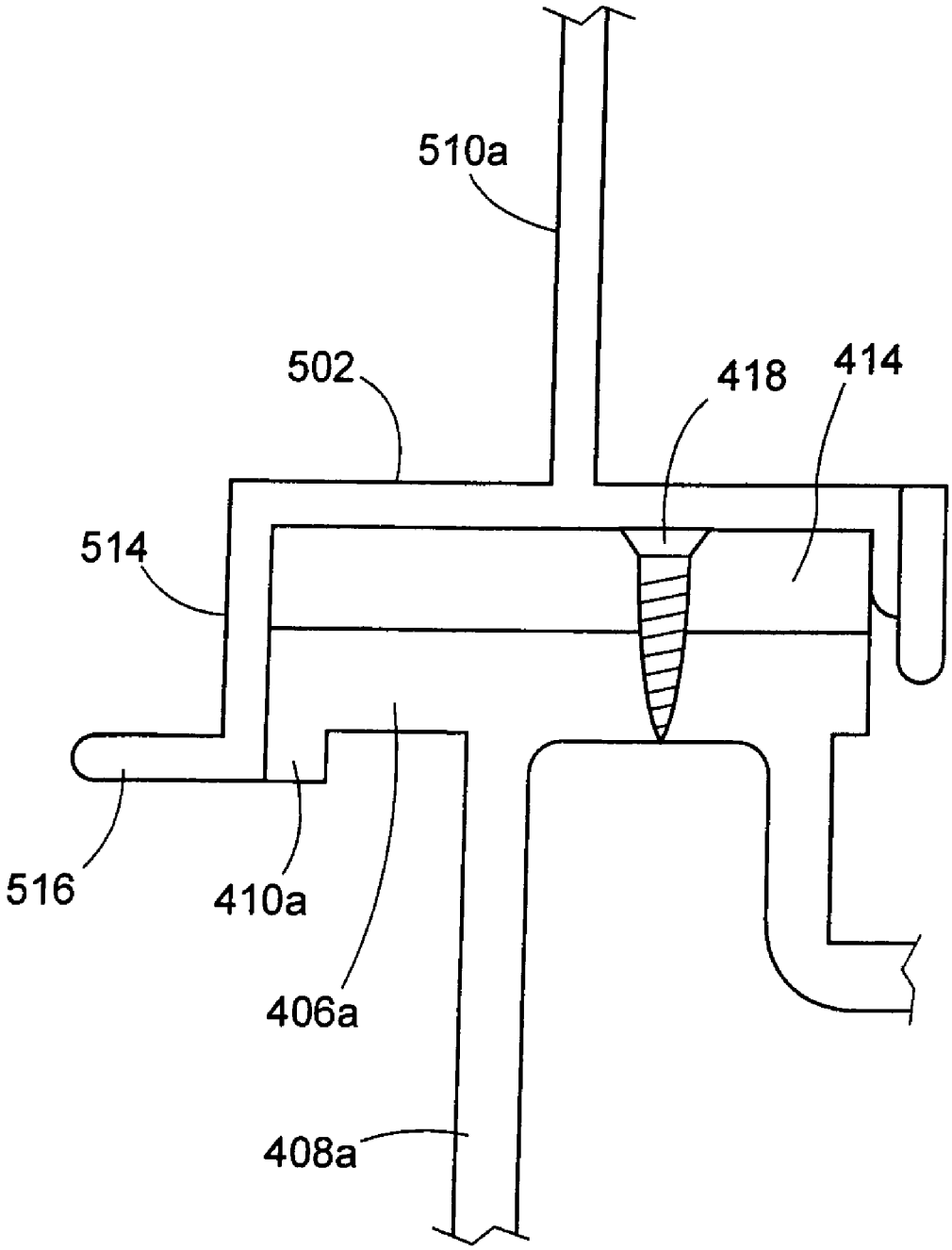
FIG. 5*b* shows the support member and ledger beam of FIG. 5 with a stopper attached to the support member.

In one embodiment, shown in FIGS. 4*a* and 5*b*, the support member 400 may have stoppers 414 attached to first edge 406*a*. These stoppers 414 may be constructed of rubber, but it will be appreciated that other materials may be used. The stoppers 414 may be attached to first edge 406*a* by screws 418, as shown in FIGS. 4*a* and 5*b*, but other attachment means may also be used.

The stoppers may be used to provide spacing between first edge 406*a* of the support member 400 and second edge 502 of the ledger beam 500. The spacing created by these stoppers 414 obviates the need for the cut-out corners shown in FIG. 6*b*, and as described above. The stoppers 414 themselves may be spaced along the first edge 406*a* of support member 400 creating gaps 420. The height of the stoppers 414 is such that flange 516 of ledger beams 500 that run perpendicular to support members 400 may rest flush against first edge 406*a* of support member 400.

Contact surface 530 may be supported by walers 520 and ledger beams 500. The contact surface 530 is a surface over which concrete may be poured, and which contact surface 530 supports said poured concrete while the poured concrete cures. The depth of contact surface 530 may be the same as the height of first ridge 508. Contact surface 530 may be fastened to the first edge 504 of ledger beam 500 and/or to first edge 522 of waler 520 by screws 532. In one embodiment, this contact surface 530 may be made of plastic. It will be appreciated that contact surface 530 may be made of suitable materials other than plastic, however, such as wood, for example.

Figure 7:
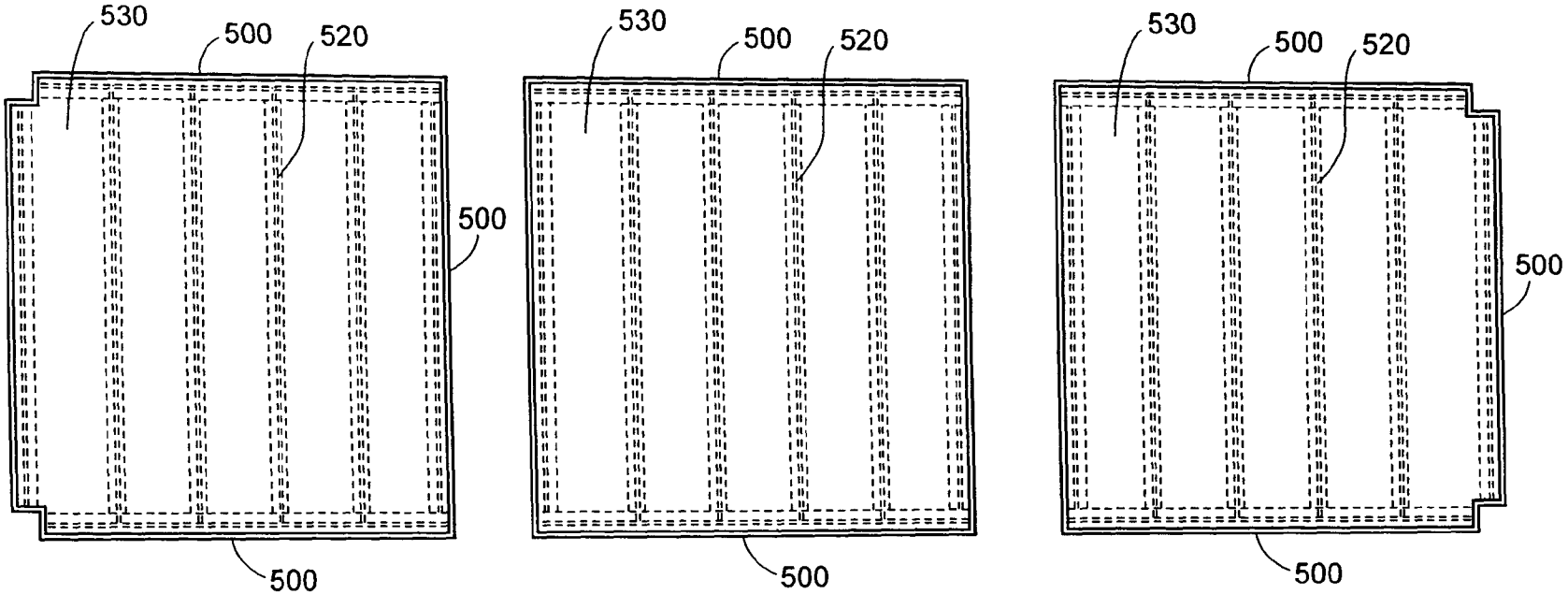
FIG. 7 is a top view of three panels of an assembled box form.

FIGS. 6 and 7 show top views of an assembled shoring assembly. FIG. 6 shows one panel of a concrete pouring form, and FIG. 7 shows three panels. Contact surface 530 is shown supported by walers 520, which are, in turn, attached to ledger beams 500. Ledger beams 500 may also support contact surface 530.

As shown in FIGS. 6 and 7, the corners of the box formed by four ledger beams 500 may be cut out to allow for second attachment plates 212 and 312 of supports 200 and 300, respectively, to contact the poured cement directly. FIG. 8 illustrates that second attachment plates 212 and 312 may be used to support the poured cement.

FIG. 8 shows a side view of an assembled shoring assembly wherein each support member 400 supports three ledger beams 500. It will be appreciated that a different number of ledger beams 500 may be supported by support member 400 depending on the size of each of the ledger beams 500 and the support members 400 desired to be used.

Contact surface 530 supports concrete that is poured thereon. Once the concrete has cured, contact surface 530 may be removed, and the cured concrete will stay in place. From FIG. 8, it will be appreciated that when supports 100, 200 and 300 are collapsed, as described, the shoring assembly may be quickly and easily moved from beneath the cured concrete, and may then be placed above the cured concrete, to support further concrete forms, such as additional storeys in buildings in a construction project. This is referred to as using a "flying form". A shoring assembly can be easily disengaged from the cured concrete and "flown" above it, to be used for the next storey.

Where supports 200 and 300 are used, when the platforms 230 and 330 comprising retaining bars 234*a* and 234*b*, and 334*a* and 334*b*, respectively, are dropped, second attachment plates 212 and 312, respectively may stay in place to provide support for the cured concrete, while still allowing support members 400, ledger beams 500, walers 520 and contact surface 530 to be removed and used in shoring assemblies to be employed in pouring concrete for other applications, such as additional storeys.

Figure 11:
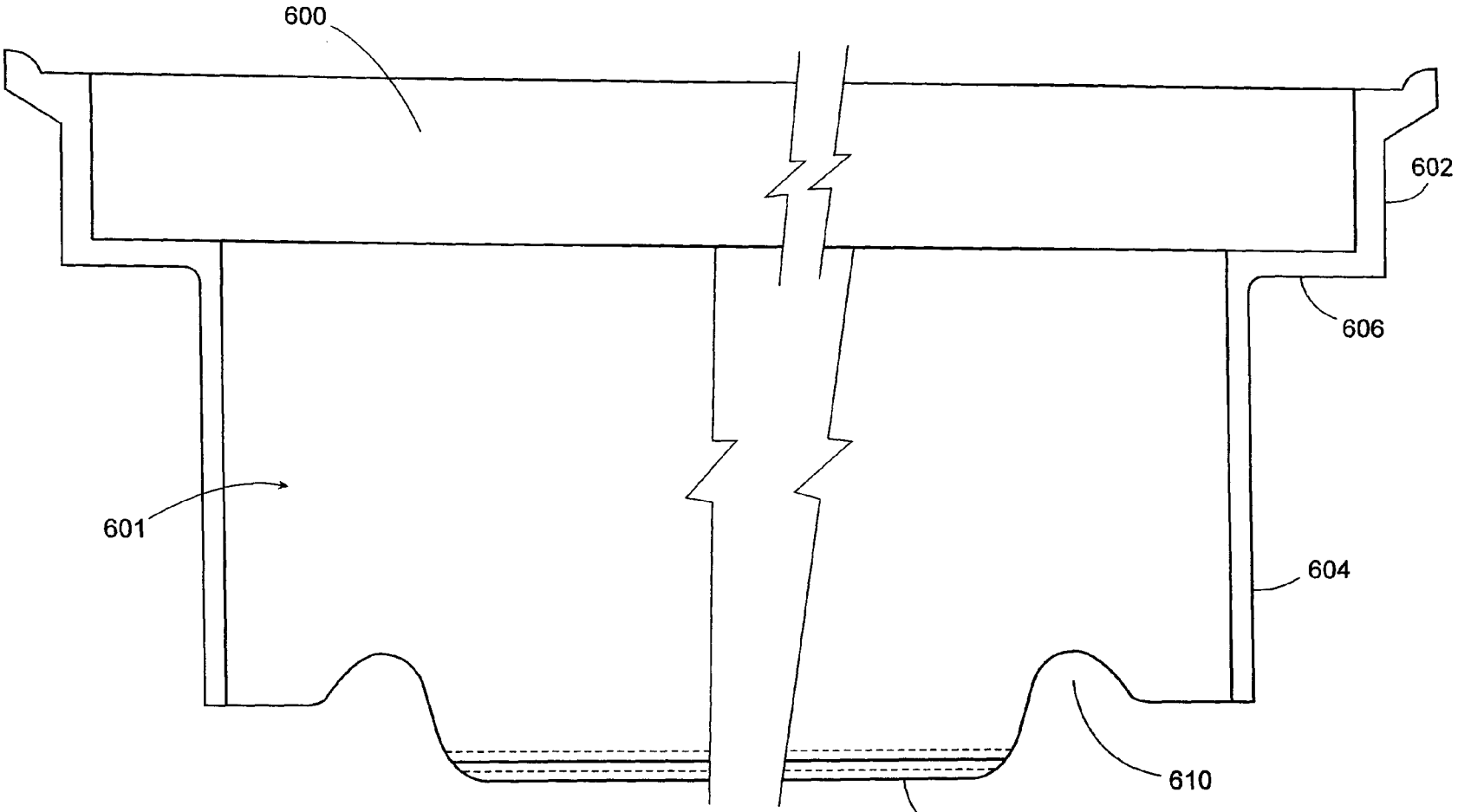
FIG. 11 is a side view of a wall of a support panel and support frame.
Figure 13:
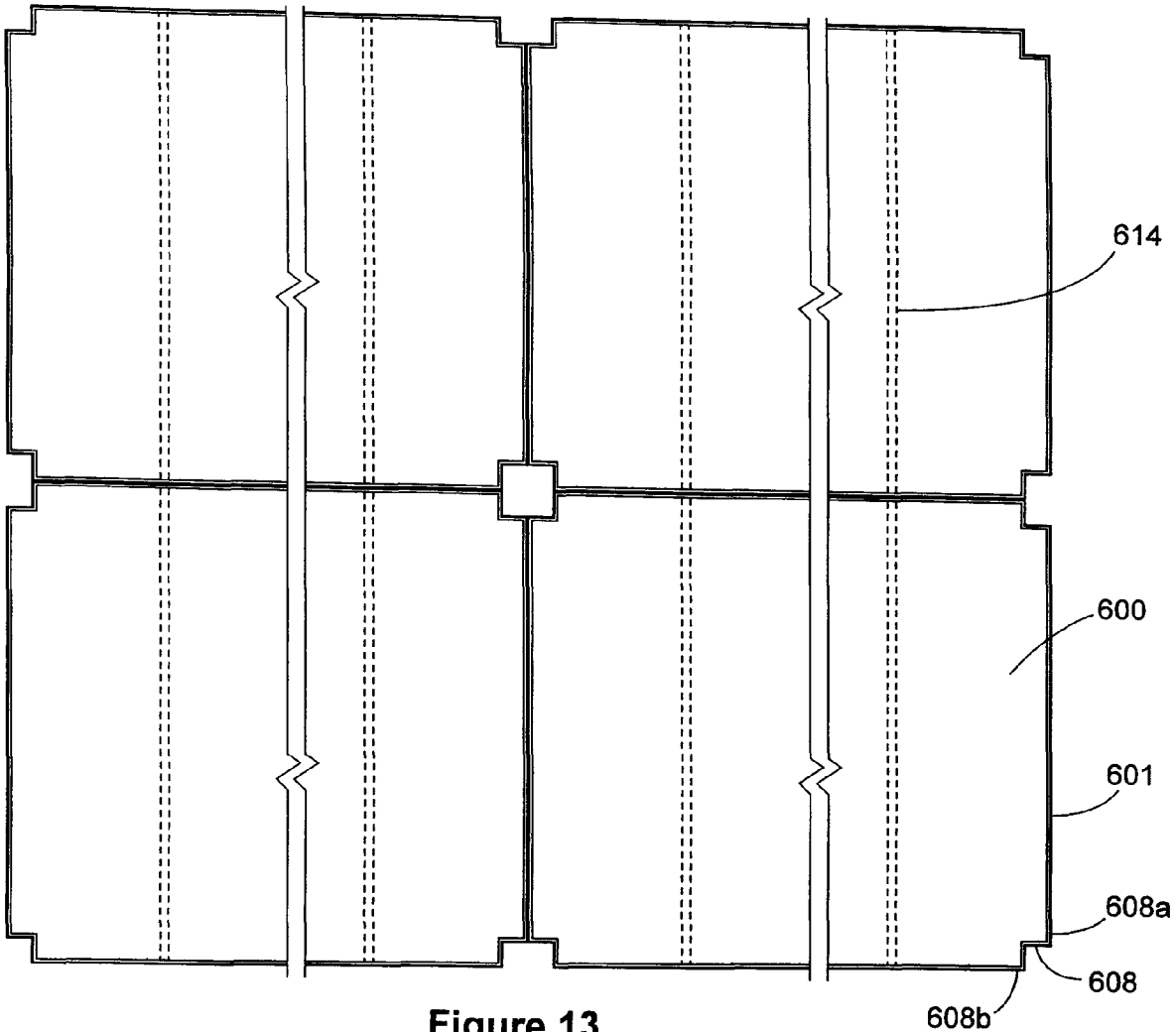
FIG. 13 is a top view of four support panels bordered by support frames.

In another embodiment of the invention, a support panel 600 can be used as a base for forming slabs of concrete. The support panel 600 may be supported by a support frame 601, as shown in FIG. 11. Support frame 601 may be comprised of four walls to form the general shape of a rectangle or square, as shown in FIG. 13. It will be appreciated, however, that other shapes and numbers of walls may be used to form support frame 601.

Figure 10:
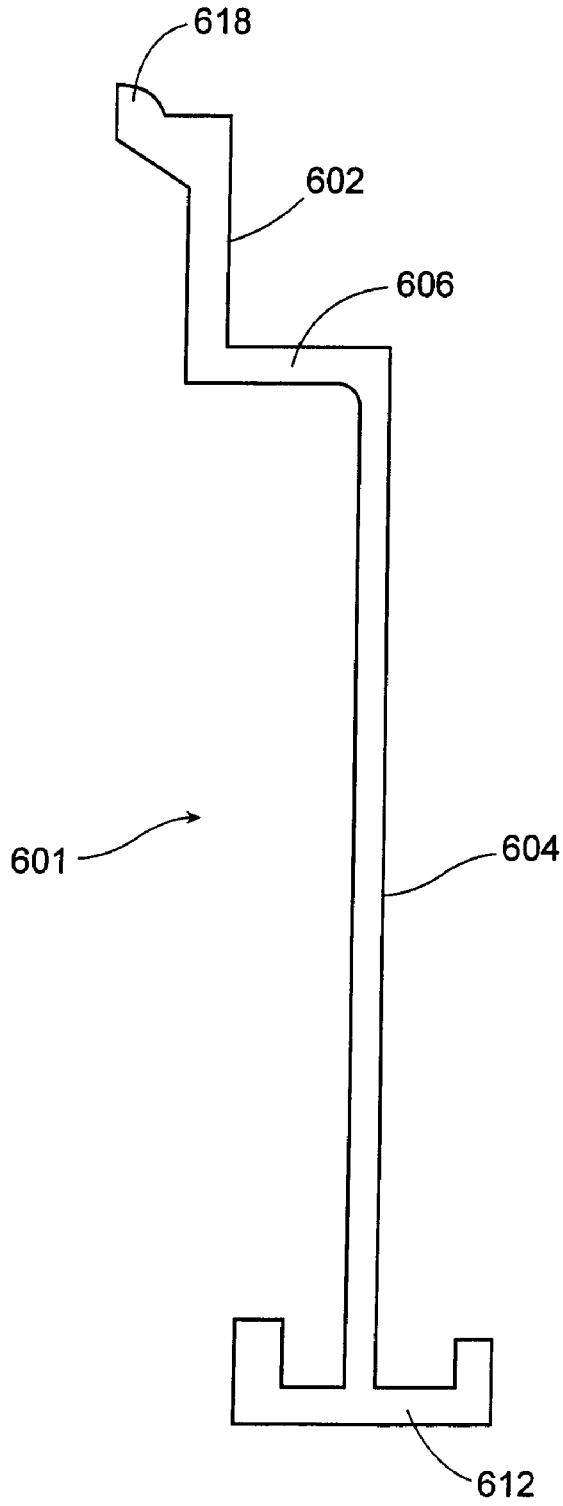
FIG. 10 is a cross section of one wall of a support frame.

FIG. 10 shows the shape in cross section of one wall of support frame 601. Each wall of support frame 601 may have two substantially vertical sections 602 and 604, and a substantially horizontal section 606 joining substantially vertical sections 602 and 604. Each wall of support frame 601 may also have a base 612.

Figure 12:
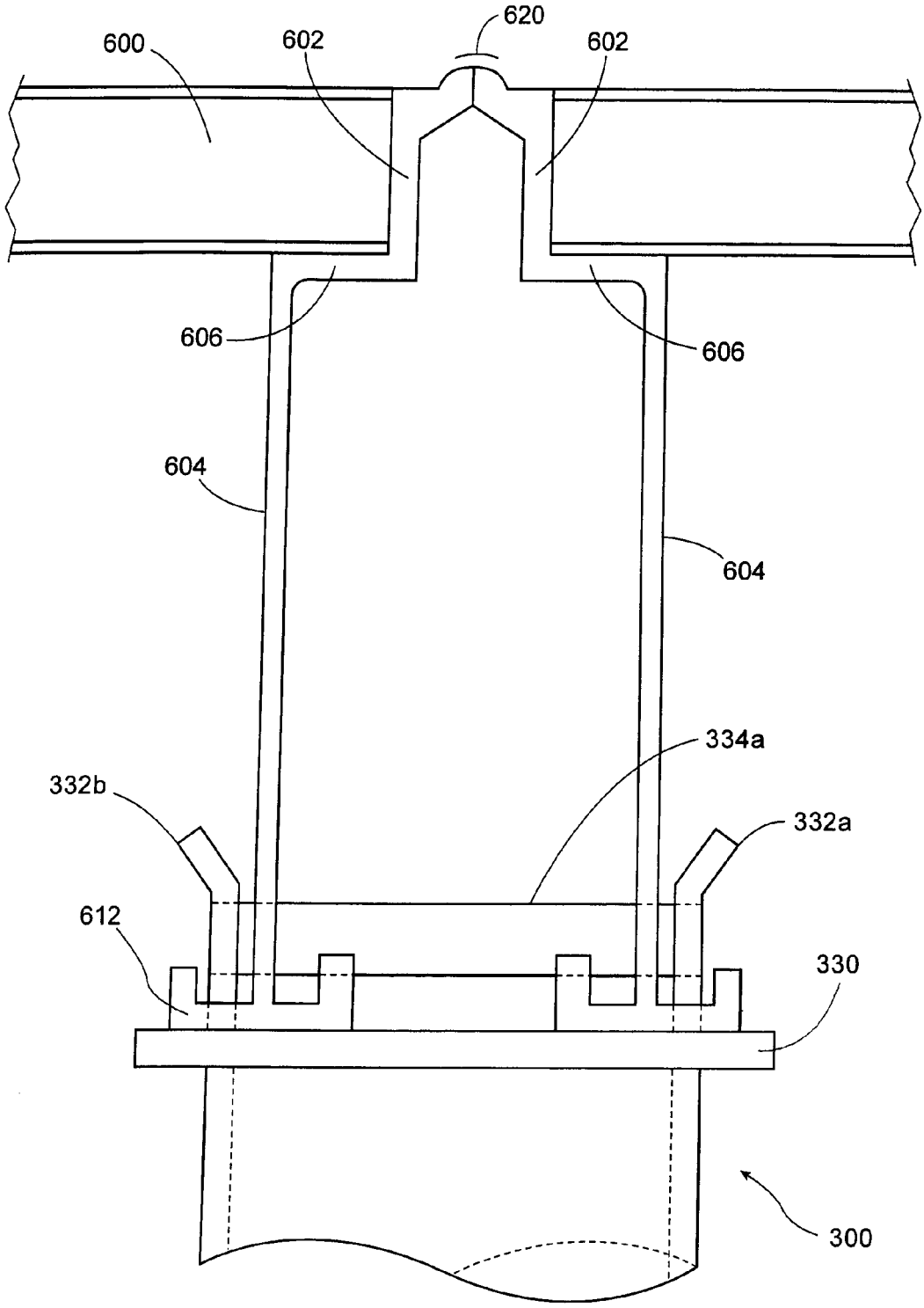
FIG. 12 is a cross sectional view of portions of two support panels and two support frames supported by a portion of a length adjustable support member.

Support panel 600 may be sized such that it fits within the perimeter of the support frame 601 as defined by substantially vertical section 602, and such that it rests on a shelf formed by substantially horizontal sections 606. In this manner, substantially horizontal sections 606 support support panel 600. FIG. 12 shows segments of support panels 600 resting on substantially horizontal sections 606 and bordered by substantially vertical sections 602.

It will be appreciated that the use of support frame 601 may obviate the need for the support member 400 and ledger beams 500, as described above. As shown in FIG. 13, one or more walers 614 may be used under support panels 600 for additional support. Walers 614 may extend between, and be attached to, opposing substantially vertical sections 604 of support frame 601.

Support frames 601 may also comprise a notch 610, as shown in FIG. 11. Notch 610 may be similar in shape to notch 402 described above, though it will be appreciated that other shapes may also be employed. In a square or rectangular shaped support frame 601, one or more notches 610 may be disposed at or near the longitudinal ends of one or more walls of support frame 601. FIG. 11 shows one wall of a support frame 601 with notches 610 at either end of said wall. Notches 610 may be disposed in substantially vertical sections 604. It will be appreciated that base 612 is not present in those sections of support frames 601 where a notch 610 is found, as shown in FIG. 11.

Each of retaining bars 234*a* and 234*b* is adapted to fit within notch 610. Similarly, each of retaining bars 334*a* and 334*b* is adapted to fit within notch 610. This mating of the enumerated retaining bars with notch 610, as described, facilitates engagement of the support frames 601 with length adjustable supports 200 and 300. Notch 610 may be angled to allow for support frame 601 to rotate about the retaining bars 234*a* or 234*b*, or the retaining bars 334*a* or 334*b*, as the case may be, in similar fashion as shown in FIG. 4*b*.

FIG. 12 shows portions of two support frames 601 being supported by a portion of a length adjustable support. It will be appreciated that the length adjustable support of FIG. 12 can be either length adjustable support 200 or 300, or can be a support with a retaining bar of a different configuration than what is described herein. For the purposes of illustration only, FIG. 12 may be seen to represent the length adjustable support 300, though it has been presented in schematic form for ease of illustration. FIG. 12 is a cross section of portions of two support frames 601 being supported on a retaining bar 334*a*. Inner post 302 and second attachment plate 312 are not shown for ease of illustration. The view in FIG. 12 is toward the centre of length adjustable support 300. In the embodiment shown, platform 330 may extend away from the centre of length adjustable support 300 to provide a surface on which base 612 may rest, which may provide additional support for support frame 601. It will be appreciated that this extension of platform 330 may not be necessary where the retaining bars alone will provide support for support frame 601. In the embodiment shown, support arms 332*a* and 332*b* are bent away from support frame 601 above retaining bar 334*a* to facilitate engagement of notch 610 in support frame 601 with retaining bar 334*a*. It will be appreciated that, in other embodiments, support arms may not be bent.

In one embodiment, the top edge of support frames 601 may also comprise a protuberance 618. In the embodiment shown in FIG. 10, protuberance 618 has the profile of a quarter circle. It will be appreciated that other shapes for the protuberance may also be employed.

Where two edges of supports frames 601 abut, as shown in FIG. 12, protuberances 618 come together to form a ridge 620. When concrete is poured on the support panel 600, the concrete will flow over ridge 620. This will leave an indentation in the dry concrete. Leakage of cement is known to occur between the edges of support frames or support panels in typical concrete pouring forms. Where this leakage occurs on a flat surface, it will be appreciated that this may leave a ridge in the dried concrete on the finished dry surface. For aesthetic or structural reasons, it may then be desirable to remove this ridge. The ridge can be removed by grinding, for example. With the indentation produced by ridge 620, the ridge in the dried concrete will be formed within this indentation. As such, the ridge may not need to be removed. The indentation itself may be filled, for example with plaster, or it may be allowed to remain. This may be preferable to removing a ridge as described above.

In one embodiment, base 612 of support frame 601 can rest directly on second attachment plates 112 or 312, depending upon the type of length adjustable support employed.

As shown in FIG. 13, support frames 601 may comprise cut out corners 608. Cut out corners 608 may be formed by substantially perpendicular inward bends in the walls of support frame 601 at the corners of support frame 601. These cut out corners 608 permit second attachment plates 212 and 312 of length adjustable supports 200 and 300, respectively, to protrude therethrough and to lie flush with the concrete being poured. Where cut out corners 608 are employed, notches 610 may be disposed at the ends of the walls of the support frame 601 as at 608*a* or 608*b*, or both, as shown in FIG. 13.

Figure 18:
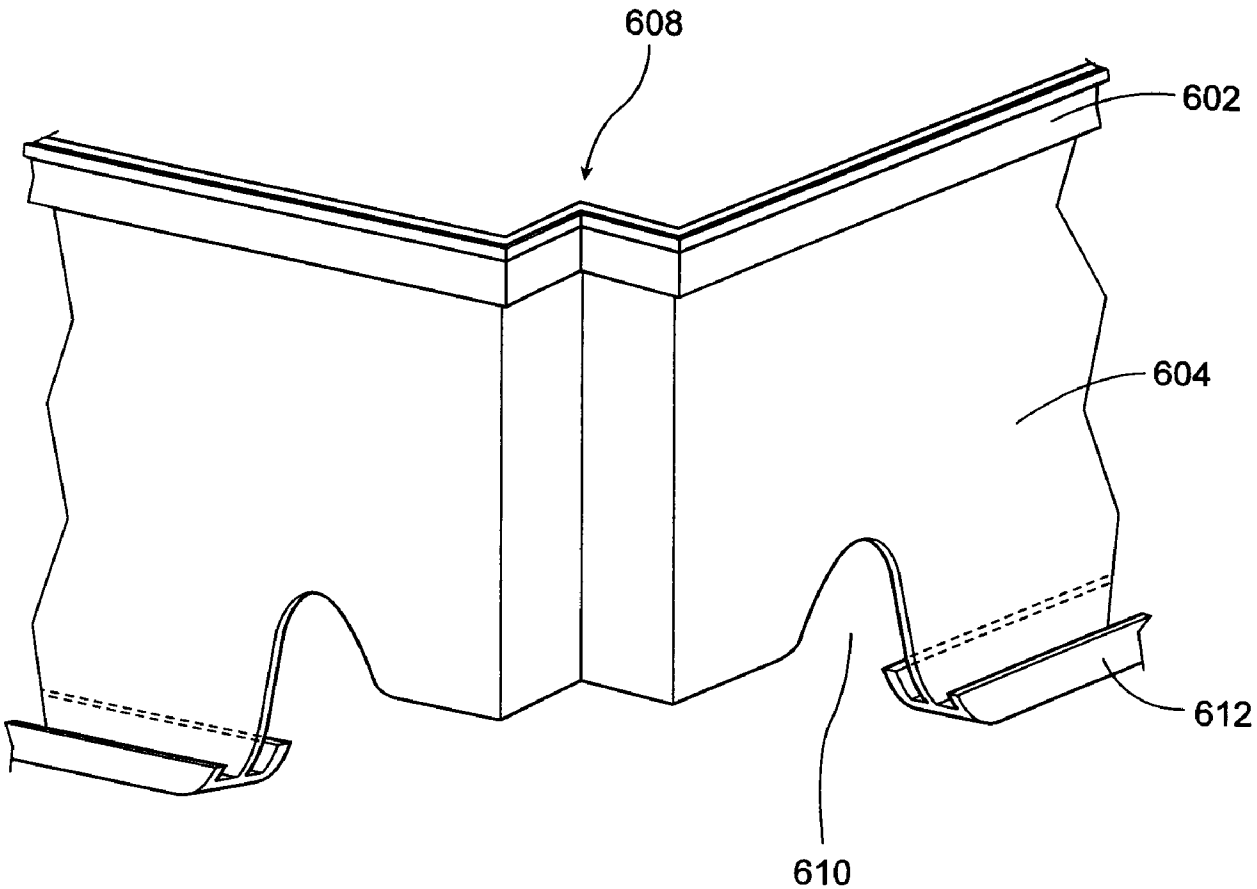
FIG. 18 is a perspective view showing a cut out corner region and notches in a support frame.

FIG. 18 shows a corner of a support frame 601 with a cut out corner 608 in perspective view.

It will be appreciated that support frames 601 may not comprise cut out corners 608. Notches 610 may still be employed in such support frames 601, but it will be appreciated that, in this embodiment, in order for notches 610 to rest on retaining bars 234*a*, 234*b*, 334*a* or 334*b*, length adjustable supports 200 or 300, as the case may be, may need to be modified such that inner post 202 or 302, as the case may be, would protrude a minimal amount, or not at all, above platform 230 or 330, as the case may be. In addition, second attachment plates 212 and 312, as the case may be, may not be used in this configuration.

It will be appreciated that support frames 601 may also not comprise notches 610.

In one embodiment, the support panels 600 can be made out of plastic. In another embodiment the support panels 600 can be made out of a composite material. It will be appreciated that the support panels 600 may also be fabricated using other materials.

Support frame 601 may be made out of aluminium. It will be appreciated, however, that support frame 601 may be made out of other materials.

Figure 14:
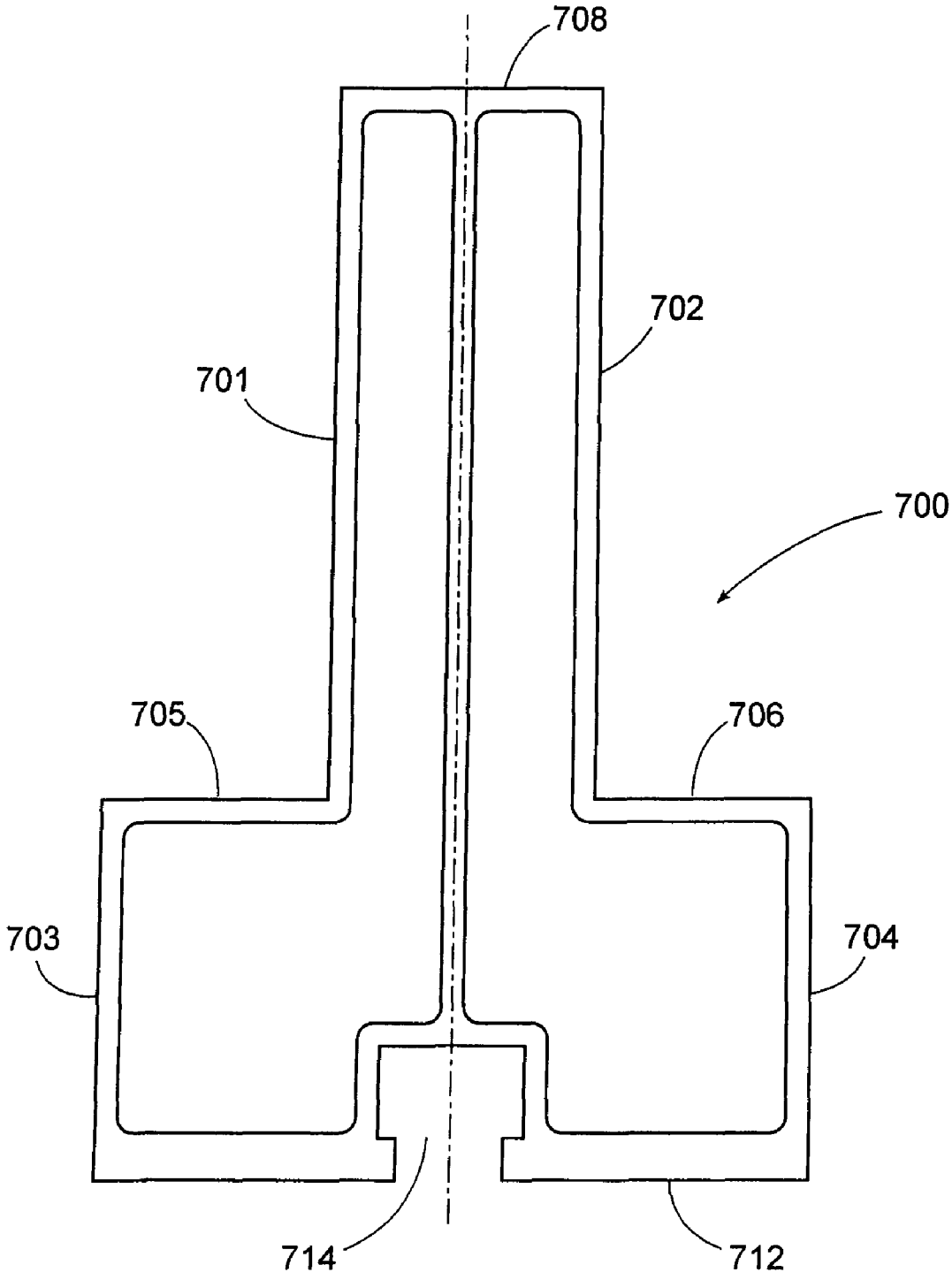
FIG. 14 is a cross sectional view of a beam.
Figure 16:
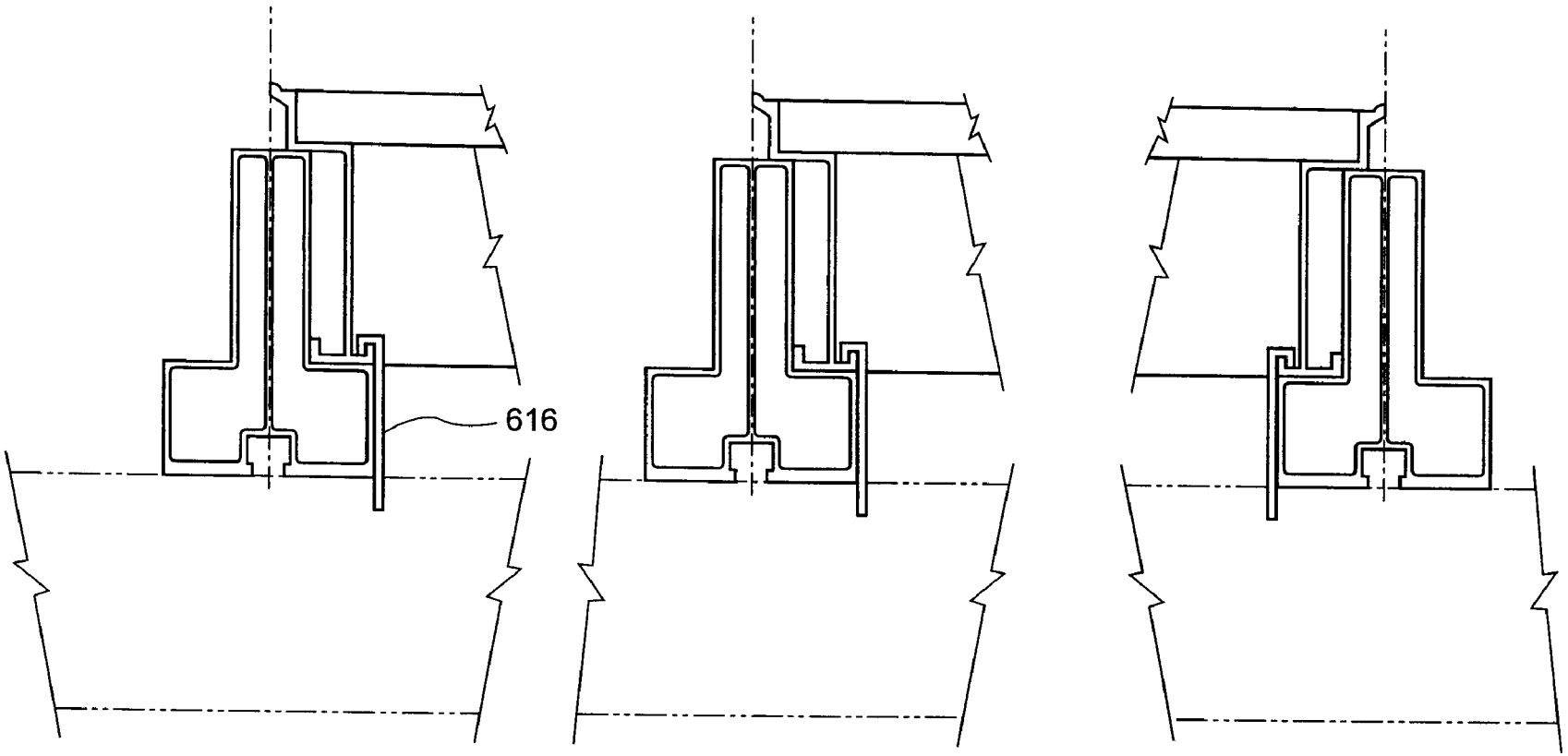
FIG. 16 is a an end view of beams supporting support panels and support frames.

In another embodiment, beams 700 may be used to support support frames 601. As shown in FIG. 14, beams 700 comprise substantially vertical sections 702 and 704, and a substantially horizontal section 706 joining substantially vertical sections 702 and 704. Beam 700 also comprises a top surface 708. The length of substantially vertical section 702 is such that base 612 of support frame 601 may rest against substantially horizontal section 706 of beam 700, while, at the same time, substantially horizontal section 606 of support frame 601 may rest against top surface 708, as shown in FIG. 16. Beam 700 also comprises a base 712. A groove 714 may be disposed in base 712. This groove 714 may be used to facilitate attachment of the beam 700 to other surfaces. By way of example only, groove 714 may be a bolt groove.

In one embodiment, beam 700 may comprise substantially vertical sections 701 and 703, and a substantially horizontal section 705 joining substantially vertical sections 701 and 703. The dimensions of substantially vertical sections 701 and 703 and substantially horizontal section 705 may be identical to substantially vertical sections 702 and 704 and substantially horizontal section 706, respectively, thus permitting each side of the beam 700 to support an edge of a support frame 601.

Gripping plates 616 may be attached to beam 700 and support frame 601 to strengthen their attachment to each other. This attachment may be by bolting, for example. It will be appreciated, however, that other attachment means to attach gripping plates 616 to beam 700 and support frame 601 may also be employed. In the embodiment shown in FIG. 16, gripping plates 616 are shown attached to substantially vertical section 704 of beam 700 and to base 612 of support frame 601. It will be appreciated that gripping plates 616 may be fastened to other sections of support frame 601 and beam 700 to still obtain the desired effect.

Figure 15:
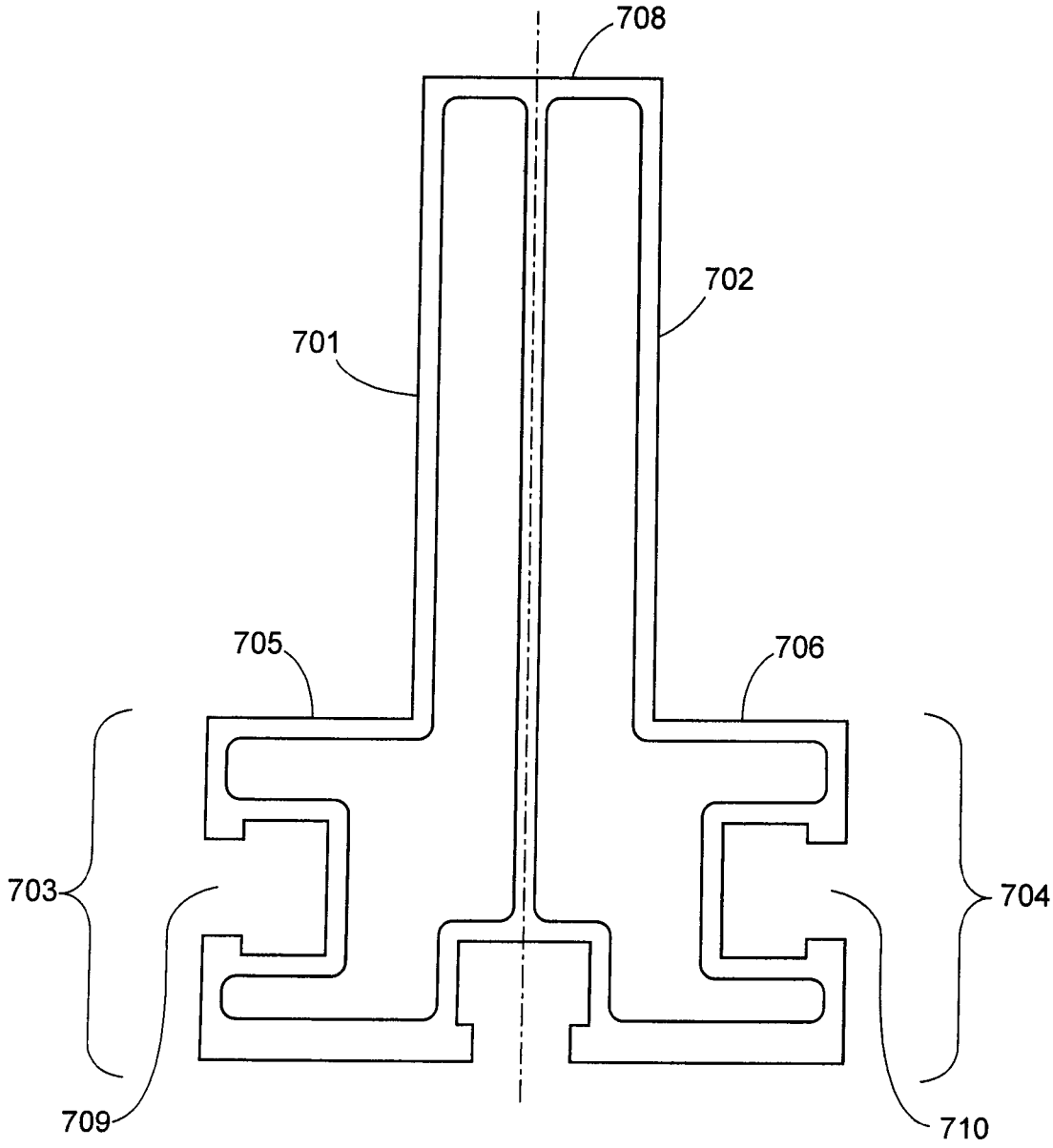
FIG. 15 is a cross sectional view of an alternate embodiment of a beam.

FIG. 15 shows an alternate embodiment of beam 700. In the alternate embodiment, substantially vertical sections 703 and 704 may have slots 709 and 710 disposed therein. Slots 709 and 710 are shaped to facilitate attachment of gripping plates 616 to beam 700. It will be appreciated that slots 709 and 710 may also facilitate engagement with the beam 700 of other attachments that may be required on a job site.

Figure 17:
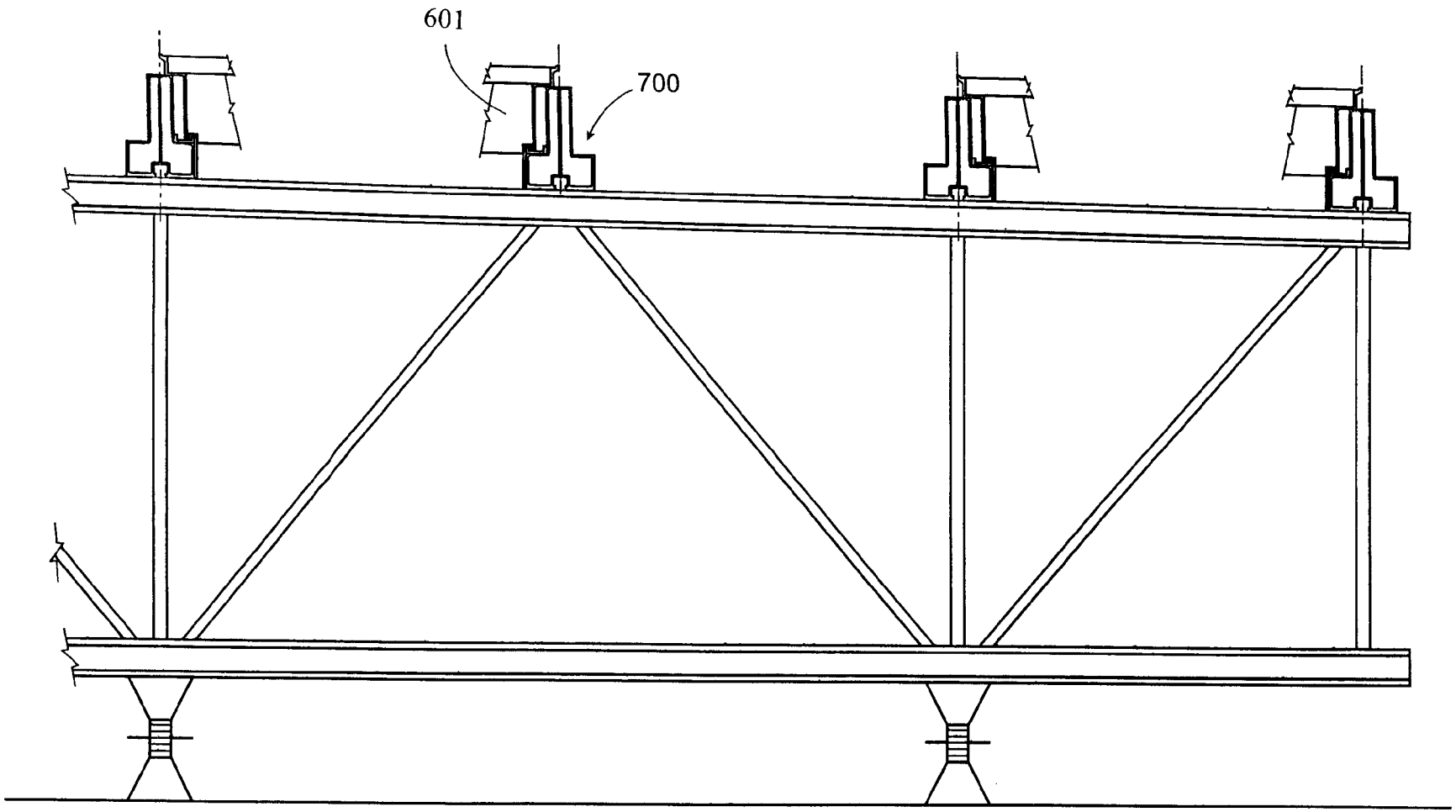
FIG. 17 is an end view of beams supporting support panels and support frames on a flying form assembly.

As shown in FIG. 17, beams 700 may be supported by a traditional flying form assembly. In another embodiment, base 712 of beam 700 can rest directly on second attachment plates 112 or 312, depending upon the type of length adjustable support employed. It will be appreciated, however, that other supports for beams 700 may be employed.

Although the invention has been described with reference to certain specific embodiments, various modifications thereof will be apparent to those skilled in the art without departing from the spirit and scope of the invention.

The invention claimed is:

1. A length-adjustable support, the support having a first elongate cylindrical member and a second elongate cylindrical member for telescopic sliding engagement with the first elongate cylindrical member, the said members being movable relative to each other from a collapsed position to an extended position, with one of said members providing a first slot therein in a longitudinal direction thereof that is in communication with a second slot therein in a circumferential direction thereof and generally perpendicularly disposed to said first slot, and with another of said members providing a third slot therein in registry with the second slot when the first and second members are in telescopic sliding engagement and in the said extended position, the support having a pin locatable within the said first and second slots and within the said third slot for relative movement with the first and second members, wherein locating of the pin within the second and third slots and outside of the first slot maintains the first and second members in the said extended position thereof in a locked engagement in each direction of movement of said longitudinal direction and locating of the pin within the first slot enables the first and second members to move from said extended position to said collapsed position.

2. The length-adjustable support of claim 1, wherein the support is capable of attachment to a support beam and the support comprises a means for attachment to the support beam.

3. The length-adjustable support of claim 2, wherein the means for attachment is a horizontally disposed member for latching with a support beam.

4. The length-adjustable support of claim 3, wherein the horizontally disposed member is supported by at least two vertically disposed support arms.

5. The length-adjustable support of claim 2, wherein the support further comprises a first attachment plate and a second attachment plate respectively at terminal ends thereof.

6. The length-adjustable support of claim 5, wherein at the least the first attachment plate or the second attachment plate comprise holes or notches.

7. The length-adjustable support of claim 5, wherein the support is capable of attachment to an elongate post.

8. The length-adjustable support of claim 1 further comprising an annular collar that surrounds both support members, said annular collar comprising diametrically opposed apertures through which the pin may be inserted, wherein rotation of the annular collar causes said pin to move within said second and third slots, from a position outside said first slot to a position within said first slot.

9. A length-adjustable support, the support having a first elongate member, a second elongate member, and a third elongate member, each for telescopic sliding engagement with the other said members, the said members being movable relative to each other from a collapsed position to an extended position with one of said members providing a first slot therein in a longitudinal direction thereof that is in communication with a second slot therein transversely disposed thereto, and with another of said members providing a third slot therein, and with another of said members providing a fourth slot therein in a longitudinal direction thereof that is in communication with a fifth slot therein transversely disposed thereto and in communication therewith and also providing a sixth slot therein, such that the third slot is in registry with the fifth slot when the second and third members are in telescopic sliding engagement and in the said extended position, and the second slot is in registry with the sixth slot when the first and third members are in telescopic sliding engagement and in the said extended position, the support having a pin locatable within the said first and second slots and within the said sixth slot for relative movement with the first and third members, wherein locating of the pin within the second and sixth slots and outside of the first slot maintains the first and third members in the said extended position thereof and locating of the pin within the first slot enables the first and third members to move from said extended position to said collapsed position, the support also having a pin locatable within the said fourth and fifth slots and within the said third slot for relative movement with the third and second members, wherein locating of the pin within the third and fifth slots and outside of the fourth slot maintains the third and second members in the said extended position thereof and locating of the pin within the fourth slot enables the third and second members to move from said extended position to said collapsed position.

10. The length-adjustable support of claim 9, wherein the support is capable of attachment to a support beam and the support comprises a means for attachment to the support beam.

11. The length-adjustable support of claim 10, wherein the means for attachment is a horizontally disposed member for latching with the support beam.

12. The length-adjustable support of claim 11, wherein the horizontally disposed member is supported by at least two vertically disposed support arms.

13. The length-adjustable support of claim 10, wherein the support further comprises a first attachment plate and a second attachment plate respectively at each terminal end thereof.

14. The length-adjustable support of claim 13, wherein at the least the first attachment plate or the second attachment plate comprise holes or notches.

15. The length-adjustable support of claim 13, wherein the support capable of attachment to an elongate post.

16. The length-adjustable support of claim 9, further comprising two collars that surround at least two of the support members, such that each collar comprises a pair of diametrically opposed apertures capable of accommodating one of the pins.

* * * * *